US006249087B1

(12) United States Patent
Takayama et al.

(10) Patent No.: US 6,249,087 B1
(45) Date of Patent: Jun. 19, 2001

(54) METHOD FOR DRIVING A PLASMA DISPLAY PANEL

(75) Inventors: Kunio Takayama; Koichi Sakita; Yasushi Yoneda; Kenji Awamoto; Yasunobu Hashimoto; Kazuo Yoshikawa; Tomokatsu Kishi, all of Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/560,870

(22) Filed: Apr. 28, 2000

(30) Foreign Application Priority Data

Jun. 29, 1999 (JP) ..... 11-182744

(51) Int. Cl.[7] ..... G09G 3/10

(52) U.S. Cl. ..... 315/169.1; 315/169.4; 345/63; 345/68; 345/77; 345/204; 345/208

(58) Field of Search ..... 315/169.1, 169.2, 315/169.4; 345/37, 55, 63, 67, 68, 77, 88, 94, 96, 204, 208

(56) References Cited

U.S. PATENT DOCUMENTS 5,745,086 4/1998 Weber ..... 345/63
5,962,983 * 10/1999 Anderson et al. ..... 315/169.4
6,020,687 * 2/2000 Hirakawa et al. ..... 315/169.1

FOREIGN PATENT DOCUMENTS 10-157107 6/1998 (JP) .

* cited by examiner

*Primary Examiner*—Haissa Philogene
(74) *Attorney, Agent, or Firm*—Staas & Halsey LLP

(57) ABSTRACT

A plasma display panel that can enlarge the voltage margin and can realize a stable display is provided. The plasma display panel includes first and second display electrodes X, Y for generating surface discharge and address electrodes A that cross the display electrodes via a dielectric layer. In the preparation process of the addressing for forming charge distribution corresponding to display contents, charge forming and charge adjusting are performed. The charge forming generates wall voltage having the same polarity at the same kind of interelectrode of all cells constituting the screen, for three kinds of interelectrodes, an interelectrode XY between the display electrodes, an interelectrode XA between the first display electrode and the address electrode, and an interelectrode YA between the second display electrode and the address electrode. The charge adjusting decreases the wall voltage by applying an increasing voltage that increases continuously or step by step.

20 Claims, 23 Drawing Sheets

PREVIOUS UNLIGHTED

PREVIOUS LIGHTED

CIRCUIT FOR APPLYING A RAMP WAVEFORM INCREASING TO THE POTENTIAL V1

PREVIOUS UNLIGHTED

PREVIOUS LIGHTED

METHOD FOR DRIVING A PLASMA DISPLAY PANEL

BACKGROUND OF THE INVENTION

1. Field of the Invention

The present invention relates to a method for driving a plasma display panel (PDP).

As a display device for a television set with a large screen, a surface discharge type AC plasma display panel is commercialized. This surface discharge type has first and second display electrodes that are arranged in parallel on a front side or a backside substrate as anodes and cathodes of display discharge for securing intensity. In the surface discharge type, three kinds of fluorescent material for color display, which is red, green and blue fluorescent material, can be disposed separately from the pair of display electrodes in the direction of the thickness of the panel. Thus, a deterioration of the fluorescent layer due to an ion impact upon discharge is reduced so that a long life color screen can be realized.

If the screen becomes larger, it is more difficult to make a cell structure uniform. If the cell becomes smaller, a small difference of the cell structure affects the discharge characteristics more largely. Therefore, in order to promote a wide screen and a high definition of the screen, a driving method is necessary that can permit a variation of the discharge characteristics and has a large margin of voltage.

2. Description of the Prior Art

As an electrode matrix structure of the surface discharge type plasma display panel, a "three-electrode structure" is known widely, in which an address electrode is arranged to cross a pair of display electrodes. The three-electrode structure basically has a pair of display electrodes for each row. An arrangement distance of the display electrodes in each row (a surface discharge gap length) is set to several dozens of microns so that the discharge can be generated by application of a voltage at approximately 150–200 volts. An electrode gap between neighboring rows is set to a value that is sufficiently larger than (several times of) the surface discharge gap length. The arrangement distance of the display electrode in each row is different from that between the rows. In another three-electrode structure, display electrodes whose number is one larger than the number n of the screen rows are arranged at an equal pitch, and the surface discharge is generated by neighboring electrodes as an electrode pair.

The display utilizes a memory function of a dielectric layer that covers display electrodes. Namely, addressing is performed for forming a charged state corresponding to a display contents in the line scanning format, and then a sustaining voltage Vs having alternating polarity is applied to the display electrode pair of each row. One of the display electrodes (a second display electrode) is used as a scanning electrode for addressing, and the address electrode is used as a data electrode.

The sustaining voltage Vs satisfies the following equation (1).

$$Vf-Vw<Vs<Vf \quad (1)$$

Here, Vf is a discharge starting voltage and Vw is a wall voltage between display electrodes.

When the sustaining voltage Vs is applied, a cell voltage Vc (a sum of the applied voltage and the wall voltage, which is also referred to as an effective voltage Veff) exceeds the discharge starting voltage Vf in the cell having the wall charge, so that the surface discharge is generated along the surface of the substrate. By shortening the application period of the sustaining voltage Vs, an apparent continuous lighting state is obtained.

Since the cell of the plasma display panel is a binary light emitting element, middle tones are reproduced by setting the number of discharge times per one field in each cell in accordance with a gradation level. Color display is one of the gradation displays, and the display color of the display depends on a combination of intensity of three fundamental colors. The word "field" means a unit image of a sequential image display in this specification. In the television, it means each field of an interlace format frame, while in a non-interlace format such as a computer output, it means a frame itself. For the gradation display, one field includes plural subfields having weights of intensity, and the total number of discharge of one field is set by combining on and off of each subfield. If the application period (drive frequency) of the sustaining voltage Vs is constant, the application time of the sustaining voltage Vs is different between different weights of intensities.

In general, an addressing preparation period is assigned to the subfield along with an addressing period and a sustaining period. At the end of the sustaining period, cells with remaining wall charge and cells without remaining wall charge are mixed. Therefore, the charged states of all cells are uniformed in the addressing preparation period so that the reliability of the addressing is improved. Fundamentally, all cells are set to non-charged state in the addressing preparation period for a writing format addressing, while a constant quantity of wall charge is formed in all cells for an erasing format addressing. However, there is a little variation of discharge characteristics between cells in fact. Therefore, if the charge quantity of all cells is made uniform, the voltage margin of addressing is narrowed by the variation of the characteristics.

A method of performing a preparation process is proposed in U.S. Pat. No. 5,745,086 and Japanese unexamined patent publication No. 10-157107. The method includes a charge forming step and a charge adjusting step for enlarging the voltage margin of the addressing. In the charge forming stage, wall voltage having the same polarity is generated in all cells. It is not required to control the charge quantity strictly. In the charge adjusting step, a slowly increasing voltage having a small gradient (a ramp voltage used here) is applied so as to decrease the wall voltage to an appropriate value.

The principle of the charge adjusting will be explained as follows. When applying an appropriate mild ramp voltage as the conventional driving method shown in the Japanese unexamined patent publication No. 10-157107, the cell voltage Vc reaches the discharge starting voltage Vf, and after that a weak discharge occurs periodically so that the wall voltage drops gradually. The cell voltage alters a little with the drop of the wall voltage and the increase of the application voltage. However, it is kept substantially at the discharge starting voltage Vf. In addition, if an extremely gentle ramp voltage is applied as the conventional method shown in the U.S. Pat. No. 5,745,086, the cell voltage Vc is close to the discharge starting voltage Vf and does not exceed the same while a continuous current flows so that the wall voltage drops gradually. In this specification, the discharge for decreasing the wall voltage gradually is referred to as a "charge adjusting discharge," which includes a state of generating a periodical minute discharge, a mixing state of discrete discharge and continuous discharge, and a state of continuous discharge. When the application of the ramp voltage is finished, the cell voltage Vc drops to the value Vwr of the wall voltage at the end of the charge adjusting discharge. This value Vwr corresponds to the difference between the discharge starting voltage Vf and the maximum value Vr of the applied ramp voltage as shown in the equation (2).

$$Vwr=Vf-Vr \quad (2)$$

It is obvious from the equation (2) that the value Vwr of the wall voltage does not depend on the value of the wall voltage at the start of the application of the ramp voltage, but depends on the setting of the maximum value Vr of the applied voltage. Therefore, in the charge forming stage, a wall voltage is generated in the range that can generate the charge adjusting discharge after that.

In the addressing after the above-mentioned charge adjusting, a pulse voltage that has the same polarity as the ramp voltage applied in the charge adjusting step is applied for generating an address discharge. Using the peak value (amplitude) Vp of the pulse voltage, the cell voltage Vc when applying the pulse voltage is expressed in the equation (3), i.e., it is the discharge starting voltage Vf plus ΔV (=Vp−Vr). If the ΔV is positive, the discharge occurs. If the ΔV is negative, the discharge does not occur.

$$Vc=Vwr+Vp=Vf-Vr+Vp=Vf+\Delta V \quad (3)$$

Here, ΔV is Vp−Vr

The values of Vr and Vp are set properly so that the discharge occurs. Thus, the differential voltage ΔV between the cell voltage Vc and the discharge starting voltage Vf becomes uniform even if the discharge starting voltage Vf has a variation among cells, so that the intensity of the discharge becomes uniform in all cells. Thus, the voltage margin is enlarged.

The above-mentioned U.S. patent and the Japanese unexamined patent publication No. 10-157107 disclose the driving method, in which a ramp voltage is applied simultaneously to two pairs of electrodes, one pair is the scanning electrode for selecting cells of addressing and the address electrode (this is referred to as an interelectrode YA), and the other pair is the display electrodes for sustaining (this is referred to as an interelectrode XY), and then a ramp voltage is applied simultaneously again for charge adjusting. Namely, the preparing process in the conventional method and the prior art includes a first step for generating a charge forming discharge at the interelectrode YA and the interelectrode XY, and a second step for generating a charge adjusting discharge at the interelectrode YA and the interelectrode XY. An increasing voltage is used for the charge forming discharge, so that the discharge intensity can be suppressed to the minimum and undesired light emission can be avoided.

In the experimental process researching the optimal application condition for applying the conventional driving method of the prior art (the driving method of performing two-step preparation), it was discovered that there is a substantial difference of the discharge characteristics of the address discharge between the "previously lighted cell" and the "previously unlighted cell". If this difference becomes small, the voltage margin increases. The previously lighted cell means the cell that was lighted in the last sustaining operation performed before the present addressing, and the previously unlighted cell means the cell except the previously lighted cell.

FIG. 21 shows voltage waveforms of the driving method of performing the two-step preparation process. FIG. 22 is a graph showing the dependence of the address discharge on the voltage in the driving method of performing the two-step preparation process. FIGS. 23A and 23B show wall voltage at the interelectrode XA in the driving method of performing the two-step preparation process.

The amplitude of the voltage pulse applied to the display electrodes X, Y and the address electrode A (a bias potential with respect to the GND) is selected as shown in Table 1 for measuring the integral value of the light emission during the display period. The display pattern includes three patterns of red color, green color and blue color, each of which is divided into the case where the cell to be lighted is the previously lighted cell and the case where the cell to be lighted is the previously unlighted cell. Thus, for total six kinds of patterns, the state of the addressing was studied using a parameter of the address voltage Va. The axis of ordinates in FIG. 22 has a relative scale standardized using the integral value of the light emission as one when all cells to be lighted are lighted properly in the display period.

TABLE 1

| Addressing Preparation | | | | | | | | |
|---|---|---|---|---|---|---|---|---|
| First Step | | | Second Step | | Addressing | | | Display |
| V1a | V1x | V1y | V2x | V2y | Vy | Vsc | Va | Vs |
| 0 | 0 | 430 | 170 | 0 | −20 | 60 | * | 170 |

(The unit is volts and * is a parameter)

As shown in FIG. 22, there is a substantial difference of the addressing characteristics between the case of the previously lighted cell and the case of the previously unlighted cell in the red cell and the green cell. The characteristics are different depending on the color because the charge characteristics of the fluorescent material and the shape (especially the thickness of the film) of the fluorescent layer are different.

In order to evaluate the charge adjusting by the driving method of performing the two-step preparation process, the wall voltage at the interelectrode XA at the end of the charge adjusting is measured for various display patterns. The interelectrode XA means between the first display electrode X that is not a scanning electrode and an address electrode A. A ramp voltage was applied instead of the addressing operation in the measurement, so that the light emission can be observed by an oscilloscope. When the sum of the increasing applied voltage and the wall voltage reaches the discharge starting voltage, discharge occurs to emit light. FIG. 22 shows the applied voltage and the transition of the output of the light emission sensor in the condition that the display pattern is all white and the voltage of the addressing preparation is selected in accordance with Table 2.

TABLE 2

| V1a | V1x | V1y | V2x | V2y |
|---|---|---|---|---|
| 0 | 0 | 440 | 170 | 0 |

(The unit is volts)

As shown in FIG. 23A, the discharge occurred when the applied voltage is 4 volts for the previously unlighted cell. As shown in FIG. 23B, the discharge occurred when the applied voltage is −26 volts for the previously lighted cell. It was discovered that there is the difference of 30 volts of the wall voltage at the interelectrode XA depending on the display pattern.

SUMMARY OF THE INVENTION

The object of the present invention is to enlarge the voltage margin of the addressing and to realize the stable display.

In the present invention, charge adjusting is performed by applying an increasing voltage just before the addressing, for all of three interelectrode related to a first display electrode, a second display electrode and an address electrode.

According to a first aspect of the present invention, the method for driving a plasma display panel is provided. The plasma display panel includes first and second display electrodes making electrode pairs for generating surface discharge for each row of a screen, a dielectric layer for insulating the electrode pairs from the discharge space and address electrodes crossing the first and second display electrodes via the dielectric layer. The method comprises a charge forming step and a charge adjusting step as a preparation process of addressing for forming charge distribution corresponding to display contents. The charge forming step generates wall voltage having the same polarity at the same kind of interelectrode of all cells constituting the screen, for three kinds of interelectrodes, an interelectrode XY between the display electrodes, an interelectrode XA between the first display electrode and the address electrode, and an interelectrode YA between the second display electrode and the address electrode. The charge adjusting step decreases the wall voltage by applying an increasing voltage that increases continuously or step by step.

According to a second aspect of the present invention, the charge forming step is performed by applying an increasing voltage that increases monotonously and continuously or step by step.

According to a third aspect of the present invention, the increasing voltage applied to at least one kind of interelectrode is a ramp voltage.

According to a fourth aspect of the present invention, the increasing voltage applied to at least one kind of interelectrode is a slow waveform voltage.

According to a fifth aspect of the present invention, the increasing voltage applied to at least one kind of interelectrode is a step voltage.

According to a sixth aspect of the present invention, a bias voltage for shortening the application period is added to the increasing voltage applied to at least one kind of interelectrode.

According to a seventh aspect of the present invention, the charge forming step and the charge adjusting step are performed for each of the three kinds of interelectrode sequentially.

According to an eighth aspect of the present invention, the application of the increasing voltage is performed for two of the three kinds of interelectrode simultaneously.

According to a ninth aspect of the present invention, the addressing is performed by generating the address discharge in both the interelectrode YA and the interelectrode XY using the second display electrode as a cathode. The preparation process includes first through third steps. The first step applies a voltage for generating charge forming discharge at the interelectrode XA and the interelectrode YA using the address electrode as a cathode. The second step applies the increasing voltage to the interelectrode XA after the first step. The increasing voltage has a polarity that makes the first display electrode a cathode. The second step also applies a voltage for generating charge forming discharge at the interelectrode XY using the first display electrode as a cathode. The third step applies the increasing voltage to the interelectrode XY and the interelectrode YA after the second step. The increasing voltage has a polarity that makes the second display electrode a cathode.

According to a tenth aspect of the present invention, the preparation process includes first through third steps. The first step applies a voltage for generating charge forming discharge at the interelectrode XY and the interelectrode XA using the first display electrode as a cathode. The second step applies the increasing voltage to the interelectrode XA after the first step. The increasing voltage has a polarity that makes the address electrode a cathode. The second step also applies a voltage for generating charge forming discharge at the interelectrode YA using the address electrode as a cathode. The third step applies the increasing voltage to the interelectrode XY and the interelectrode YA after the second step. The increasing voltage has a polarity that makes the second display electrode a cathode.

According to an eleventh aspect of the present invention, the addressing is performed by generating the address discharge in both the interelectrode YA and the interelectrode XY using the second display electrode as an anode. The preparation process includes first through third steps. The first step applies a voltage for generating charge forming discharge at the interelectrode XA and the interelectrode YA using the address electrode as an anode. The second step applies the increasing voltage to the interelectrode XA after the first step. The increasing voltage has a polarity that makes the first display electrode an anode. The second step also applies a voltage for generating charge forming discharge at the interelectrode XY using the first display electrode as an anode. The third step applies the increasing voltage to the interelectrode XY and the interelectrode YA after the second step. The increasing voltage has a polarity that makes the second display electrode an anode.

According to a twelfth aspect of the present invention, the preparation process includes first through third steps. The first step applies a voltage for generating charge forming discharge at the interelectrode XY and the interelectrode XA using the first display electrode as an anode. The second step applies the increasing voltage to the interelectrode XA after the first step. The increasing voltage has a polarity that makes the address electrode an anode. The second step also applies a voltage for generating charge forming discharge at the interelectrode YA using the address electrode as an anode. The third step applies the increasing voltage to the interelectrode XY and the interelectrode YA after the second step. The increasing voltage has a polarity that makes the second display electrode an anode.

According to a thirteenth aspect of the present invention, writing format addressing is performed in which the address discharge is generated only in the cell whose wall voltage is to increase.

According to a fourteenth aspect of the present invention, erasing format addressing is performed in which the address discharge is generated only in the cell whose wall voltage is to decrease.

According to a fifteenth aspect of the present invention, the addressing is performed by generating the address discharge having a first intensity or a second intensity in all cells.

According to a sixteenth aspect of the present invention, the interelectrode XY is supplied with a voltage that decreases the wall voltage before the application of the voltage for the charge forming.

According to a seventeenth aspect of the present invention, a power source for adding a predetermined value to the maximum value of the increasing voltage applied at the end of the interelectrode YA so as to apply a voltage for generating the address discharge to the interelectrode YA.

According to an eighteenth aspect of the present invention, the method further includes the steps of constituting the field of display information of plural subfields having weights of intensity, performing the addressing and the sustaining by applying an alternating voltage to the interelectrode XY for each subfield, and performing the preparation process in the subfields except at least one of the plural subfields.

According to a nineteenth aspect of the present invention, the method further includes the steps of performing the preparation process in which the charge forming and the charge adjusting are performed for the three kinds of interelectrodes and the shortened preparation process in which the charge forming and the charge adjusting are performed for two kinds of interelectrodes including the interelectrode XY and the interelectrode YA, selectively in accordance with contents of display.

According to a twentieth aspect of the present invention, a display apparatus is provided that includes a plasma display panel and a drive circuit. The plasma display panel includes first and second display electrodes constituting electrode pairs for generating surface discharge for each row of a screen, a dielectric layer for insulating the electrode pairs from the discharge space, and address electrodes crossing the first and second display electrodes via the dielectric layer. The drive circuit performs one of the above-mentioned methods for driving the plasma display panel.

DESCRIPTION OF THE PREFERRED EMBODIMENTS

Figure 1:
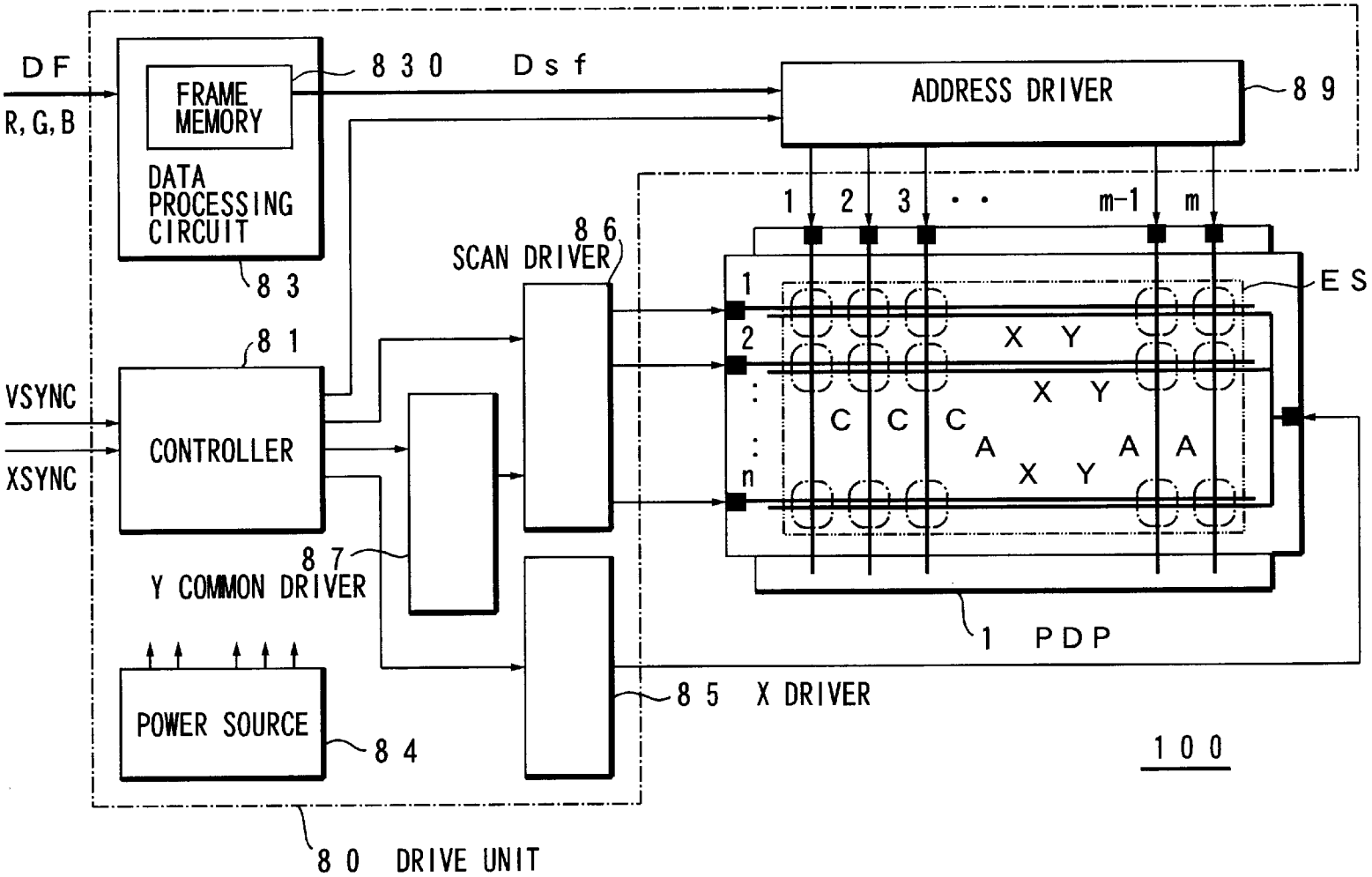
FIG. 1 shows a configuration of a plasma display apparatus according to the present invention.

FIG. 1 shows a configuration of a plasma display apparatus according to the present invention.

The plasma display apparatus 100 includes an AC type plasma display panel 1 that is a matrix format thin color display device and a drive unit 80 for selectively lighting cells arranged in a matrix of m columns and n rows that constitutes a screen ES. The plasma display apparatus 100 is used as a wall-hung television monitor or a computer monitor.

The plasma display panel 1 includes first and second display electrodes X, Y arranged in parallel forming an electrode pair for generating sustaining discharge (that is also referred to as display discharge) and address electrode A that cross the display electrodes X, Y in the cells. Namely, the plasma display panel 1 has a three-electrode surface discharge structure. The display electrodes X, Y extend in the row direction (the horizontal direction) of the screen ES, and the display electrode Y is used as a scanning electrode for selecting the cells C of a row in the addressing. The address electrode A extends in the column direction (the vertical direction) and is used as a data electrode for selecting cells C of a column.

The drive unit 80 includes a controller 81, a data processing circuit 83, a power source circuit 84, an X driver 85, a scan driver 86, a Y common driver 87 and an address driver 89. The drive unit 80 is disposed at the backside of the plasma display panel 1. The drive unit 80 is supplied with field data DF showing an intensity level (a gradation level) red, green and blue colors of each pixel by external equipment such as a TV tuner or a computer.

The field data DF are stored in the frame memory 830 of the data processing circuit 83 and are stored into subfield data Dsf for performing gradation display by dividing the field into a predetermined number of subfields as mentioned below. The subfield data Dsf are stored in the frame memory 830 and are transferred to the address driver 89 for necessity. The value of each bit of the subfield data Dsf is information indicating on or off of the cell in the subfield that is information indicating yes or no of the address discharge more.

The X driver 85 applies a drive voltage to all display electrodes X simultaneously. Electric standardization of the display electrode X is not limited to the connection on the panel as shown in the figure, but can be performed by inner wiring of the X driver 85 or by wiring on the connection cable. The scan driver 86 applies a drive voltage that is unique to each display electrode Y in the addressing. The Y common driver 87 applies a drive voltage to all display electrodes Y simultaneously for the sustaining. The address driver 89 applies a drive voltage selectively to the total m of address electrodes A in accordance with the subfield data Dsf. These drivers are supplied with a predetermined electric power by the power source circuit 84 via a wiring conductor (not shown).

Figure 2:
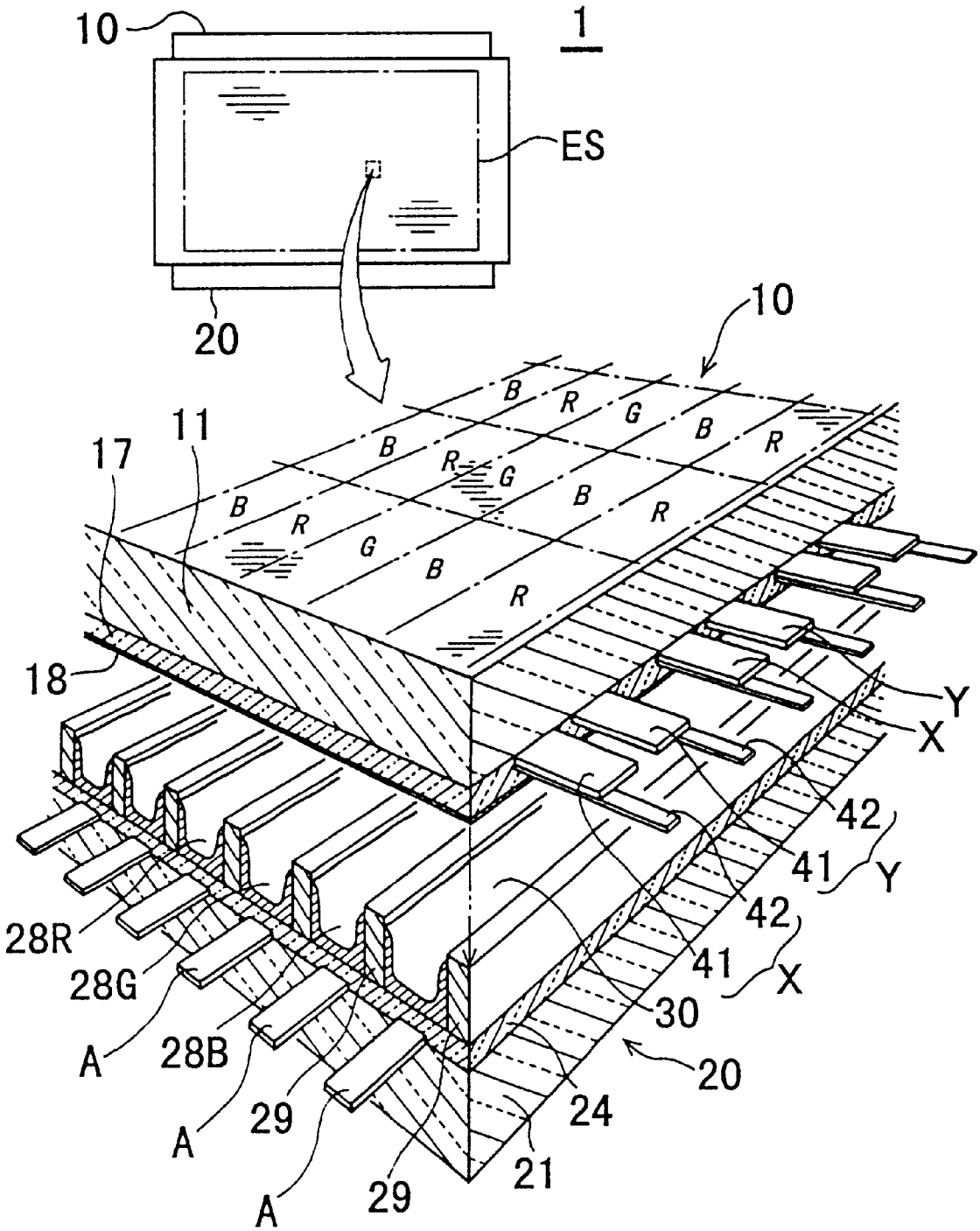
FIG. 2 is a perspective view showing the inner structure of the plasma display panel.

FIG. 2 is a perspective view showing the inner structure of the plasma display panel 1.

In the plasma display panel 1, a pair of display electrodes X, Y is arranged for each row on the inner surface of a glass substrate 11 of the front side substratal structure. The row is a set of cells in the horizontal direction of the screen. Each of the display electrodes X, Y is made of a transparent conductive film 41 and a metal film (a bus conductor) 42, covered by a dielectric layer 17 made of a low melting point glass have a thickness of approximately 30 m. The surface of the dielectric layer 17 is covered with a protection film 18 made of magnesia (MgO) having a thickness of approximately several thousands angstroms. The address electrode A is arranged on the inner surface of the glass substrate 21 of the backside substratal structure and is covered with a dielectric layer 24 having a thickness of approximately 10 m. On the dielectric layer 24, a partition 29 like a ribbon in a plan view having a height of 150 m is disposed at each space between the address electrode A. These partitions 29 define a discharge space 30 of the row direction for each subpixel (a unit area of light emission), and determine a gap size of the discharge space 30. Red, green and blue fluorescent layers 28R, 28G and 28B cover the inner surface of the backside including the upper porting of the address electrode A and the side surface of the partition 29. The discharge space 30 is filled with discharge gas containing neon as a main component and xenon. The fluorescent layers 28R, 28G and 28B are locally excited to emit light by ultraviolet rays that the xenon emits upon the discharge. A pixel of display includes three subpixels arranged in the row direction. A structural member in each subpixel is the cell (the display element) C. Since the arrangement pattern of the partition 29 is a stripe pattern, the portion of the discharge space 30 corresponding to each column is continuous in the column direction over all rows.

Hereinafter, a driving method of the plasma display panel 1 in the plasma display apparatus 100 will be explained. First, an overview of the gradation display and the drive sequence will be explained, and after that the operation unique to the present invention will be explained in detail.

Figure 3:
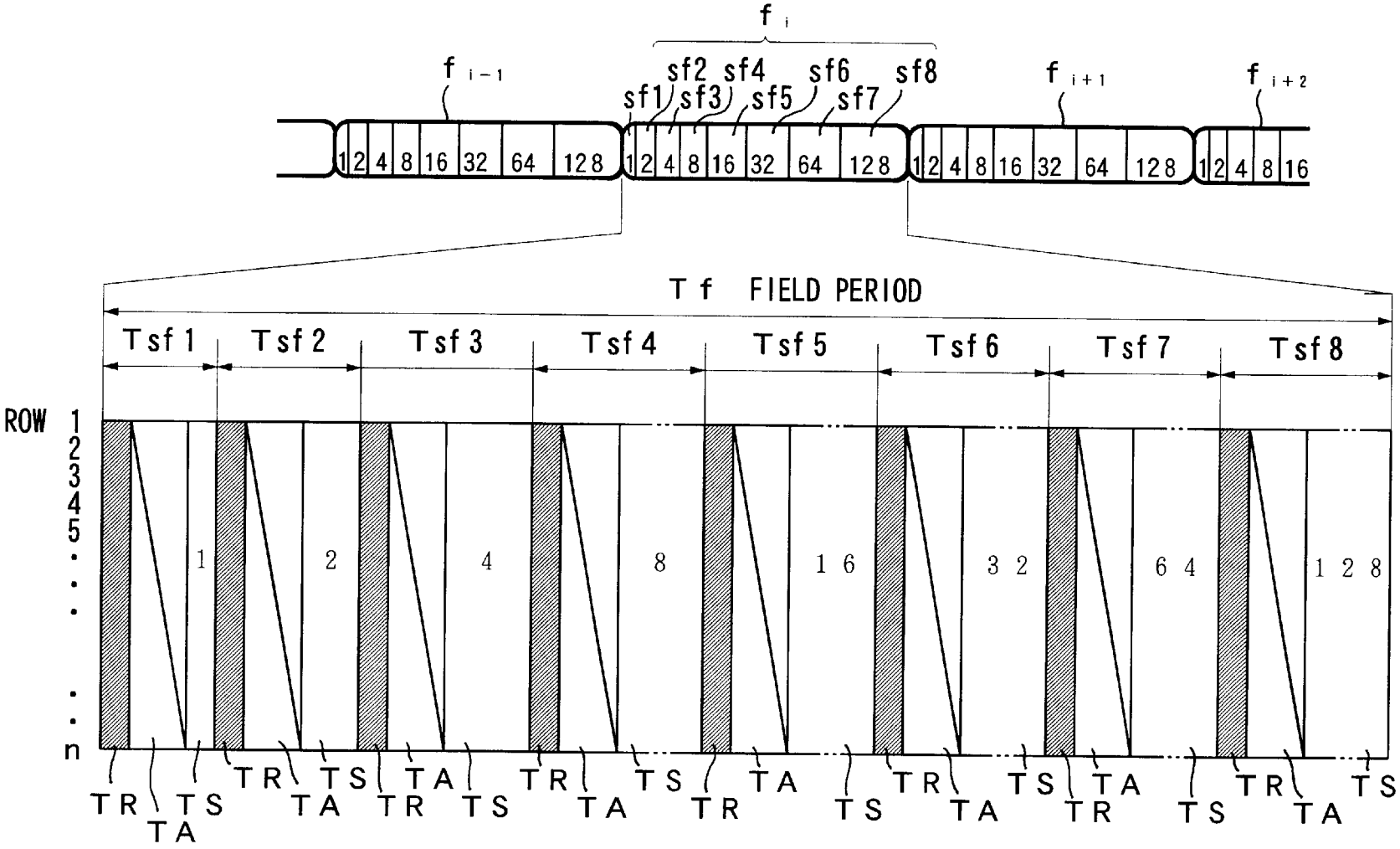
FIG. 3 shows a structure of the field.

FIG. 3 shows a structure of the field.

In the display of the television picture, sequential each field f (a suffix indicates the order of display) that is an input image is divided into eight subframes sf1, sf2, sf3, sf4, sf5, sf6, sf7 and sf8. In other words, each field f constituting the frame is replaced with a set of eight subframes sf1–sf8. In the case of reproducing a non-interlace format image such as a computer output, each frame is divided into eight. The number of sustaining discharge times of each subfield sf1–sf8 is set with weighting so that ratio of the relative intensity of these subfields sf1–sf8 becomes approximately 1:2:4:8:16:32:64:128. Since 256-step of intensity can be set by combining on and off of red, green and blue colors for each subfield, $256^3$ of colors can be displayed. However, the subfields sf1–sf8 are not necessarily displayed in the order of the weight of the intensity. For example, the subfield sf8 having a large weight is arranged in the middle of the field period Tf for optimization.

A subfield period $Tsf_j$ assigned to each subfield $sf_j$ (j=1–8) includes a preparation period TR for a charge control unique to the present invention, an addressing period TA for forming charge distribution corresponding to display contents and a display period TS for sustaining and securing the intensity corresponding to the gradation level. In each subfield period $Tsf_j$, the length of the preparation period TR and the addressing period TA is the same despite of the weight of the intensity. However, the display period TS is longer for larger weight of the intensity. Namely, the length of the period $Tsf_j$ is different in eight subfields.

Figure 4:
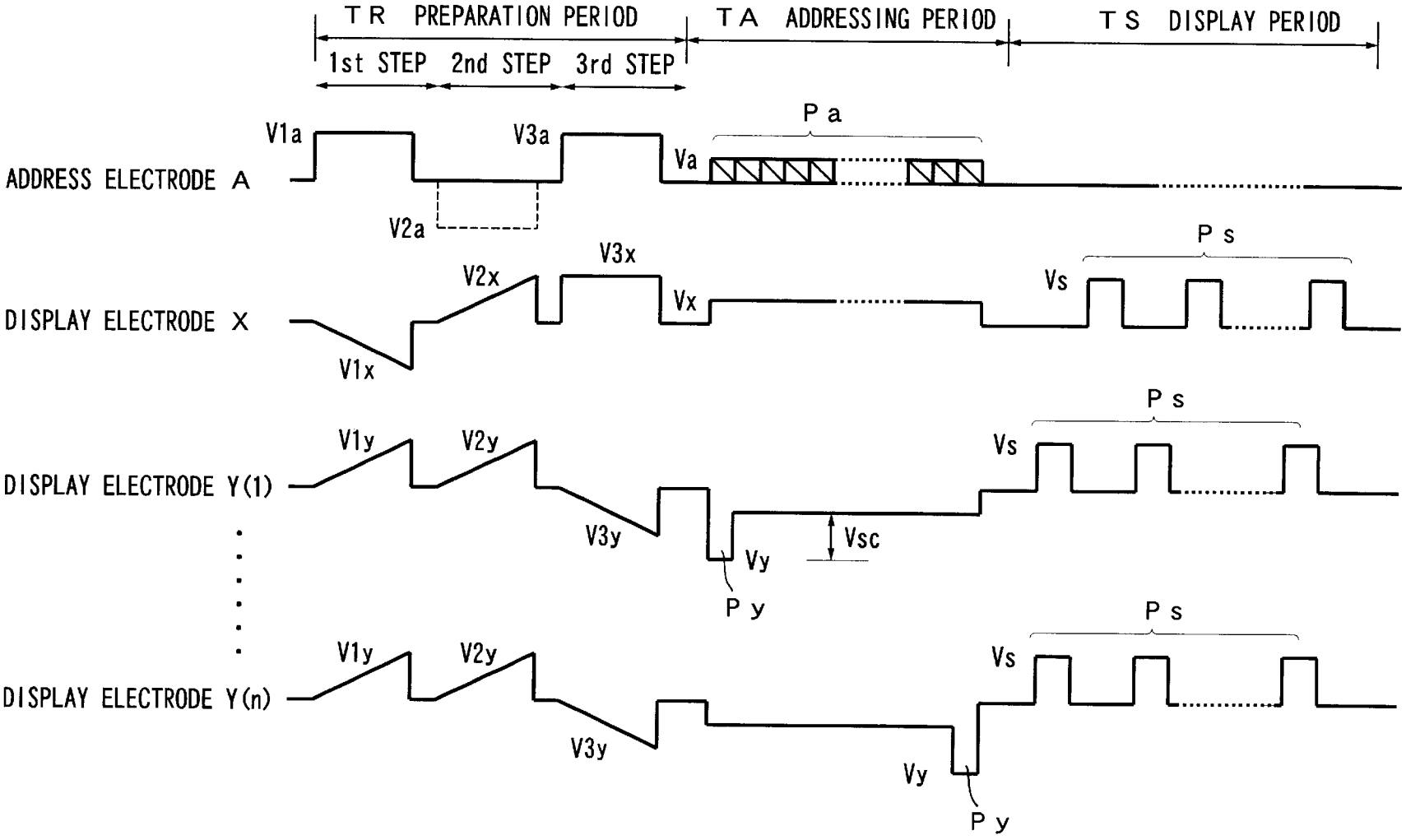
FIG. 4 shows voltage waveforms of a first example of the drive sequence.

FIG. 4 shows voltage waveforms of a first example of the drive sequence. In the figure, the character 1, n in parentheses added to the reference character of the display electrode Y indicates the arrangement order of the corresponding row. This is the same for other figures that will be explained below.

An overview of the drive sequence repeated for each subfield is as follows. In the preparation period TR, a ramp voltage as an increasing voltage is applied to three kinds of interelectrodes XY, XA and YA so as to perform the charge forming and the charge adjusting, which will be explained in detail later. In the addressing period TA, a scanning pulse Py is applied to the display electrode Y one by one so as to perform the row selection. At the same time as the row selection, an addressing pulse Pa having the opposite polarity to the scanning pulse Py to the address electrode A corresponding to the cell in which the address discharge is to be generated. For the write addressing format shown in FIG. 4, an addressing pulse Pa is applied to the cell to be lighted (the currently lighted cell). For the erase addressing format, the addressing pulse Pa is applied to the cell to be not lighted (the currently unlighted cell). In the cell that is supplied with the scanning pulse Py and the addressing pulse Pa, discharge occurs between the address electrode A and the display electrode Y, and the discharge becomes a trigger of discharge between the display electrodes X, Y. This sequence of discharges is called an address discharge. In the display period TS, a sustaining pulse Ps having a predetermined polarity (a positive polarity in this example) is applied to all display electrode Y first. After that, the sustaining pulse Ps is applied to the display electrode X and the display electrode Y alternately. The application of the sustaining pulse Ps causes a surface discharge in the currently lighted cell, and the polarity of the wall voltage between electrodes changes for each discharge.

[The Preparation Process According to the Present Invention]

In the preparation period TR, the increasing voltage is applied to two kinds of interelectrodes simultaneously. The simultaneous discharge at the plural interelectrodes decreases the number of times of the voltage application and shortens the necessary time period for the preparation process. Since the voltage between the electrodes is a difference between the electrode potentials, there are different application methods, the application of a ramp waveform pulse to one electrode, the application of ramp waveform pulses having opposite polarity to both electrodes, and the application of a ramp waveform pulse with the application of a rectangular pulse having the opposite polarity to the ramp waveform pulse. The application of the pulse means the operation of biasing the electrode temporarily to a potential different from the GND line.

First, the charge forming discharge is generated at the interelectrode XA and the interelectrode XY, so as to generate an appropriate wall voltage at these interelectrodes XA, XY (a first step). Next, a ramp voltage having the opposite polarity from the first step is applied to the interelectrode XA, and a ramp voltage is applied so that the charge forming discharge can be generated at the interelectrode YA.

Thus, the wall voltage at the interelectrode XA is reduced (the charge adjusting) and the charge forming at the interelectrode YA is performed (a second step). Then, a ramp voltage having the opposite polarity from the first step is applied to the interelectrode XY, and a ramp voltage having the opposite polarity from the second step is applied to the interelectrode YA. Thus, the charge adjusting of interelectrode YA and the interelectrode XY is performed (a third step).

Figure 5:
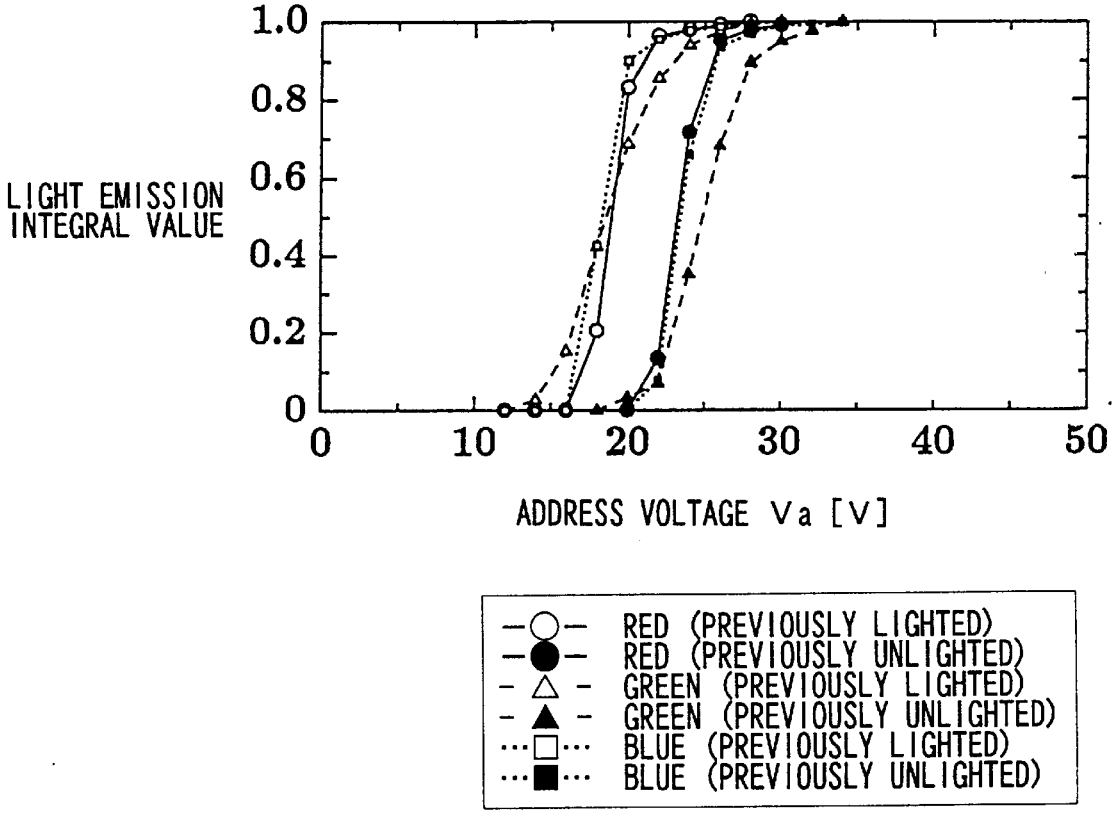
FIG. 5 is a graph showing a dependence of the address discharge on the voltage in the driving method shown in FIG. 4.
Figure 6A:
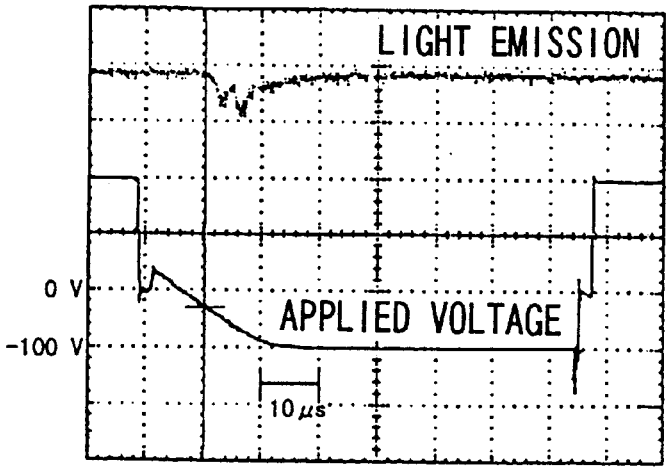
FIGS. 6A and 6B show the wall voltage of the interelectrode XA according to the driving method shown in FIG. 4.
Figure 6B:
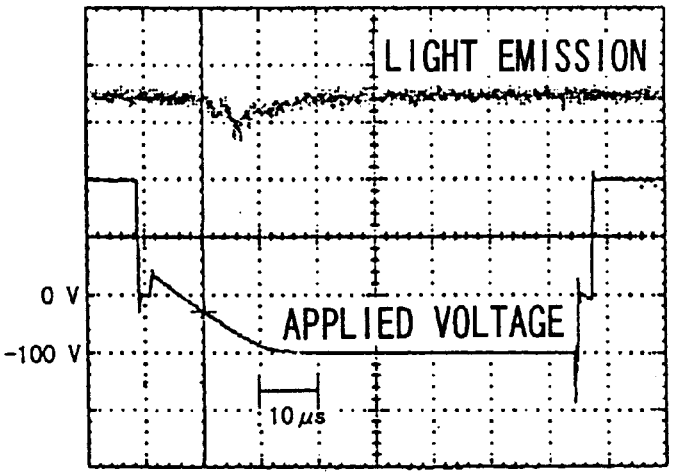

FIG. 5 is a graph showing a dependence of the address discharge on the voltage in the driving method shown in FIG. 4. FIGS. 6A and 6B show the wall voltage of the interelectrode XA according to the driving method shown in FIG. 4. The measurement methods in these figures are similar to the evaluation of the conventional method. The voltage condition in FIG. 5 is shown in Tables 3 and 4. The voltage conditions in FIGS. 6A and 6B are shown in Tables 5 and 6.

TABLE 3

| Addressing preparation | | | | | | | | |
|---|---|---|---|---|---|---|---|---|
| First Step | | | Second Step | | | Third Step | | |
| V1a | V1x | V1y | V2a | V2x | V2y | V3a | V3x | V3y |
| 80 | −200 | 120 | 0 | 200 | 340 | 0 | 100 | −86 |

(The unit is volts)

TABLE 4

| Addressing | | | | Display |
|---|---|---|---|---|
| Vx | Vy | Vsc | Va | Vs |
| 100 | −105 | 60 | * | 170 |

(The unit is volts and * is a parameter)

TABLE 5

| V1a | V1x | V1y | V2a | V2x | V2y | V3a | V3x | V3y |
|---|---|---|---|---|---|---|---|---|
| 110 | −150 | 120 | 0 | 250 | 300 | 110 | 110 | −100 |

(The unit is volts)

TABLE 6

| Vx | Vy | Vsc | Va | Vs |
|---|---|---|---|---|
| 100 | −105 | 60 | 70 | 170 |

(The unit is volts)

Figure 7:
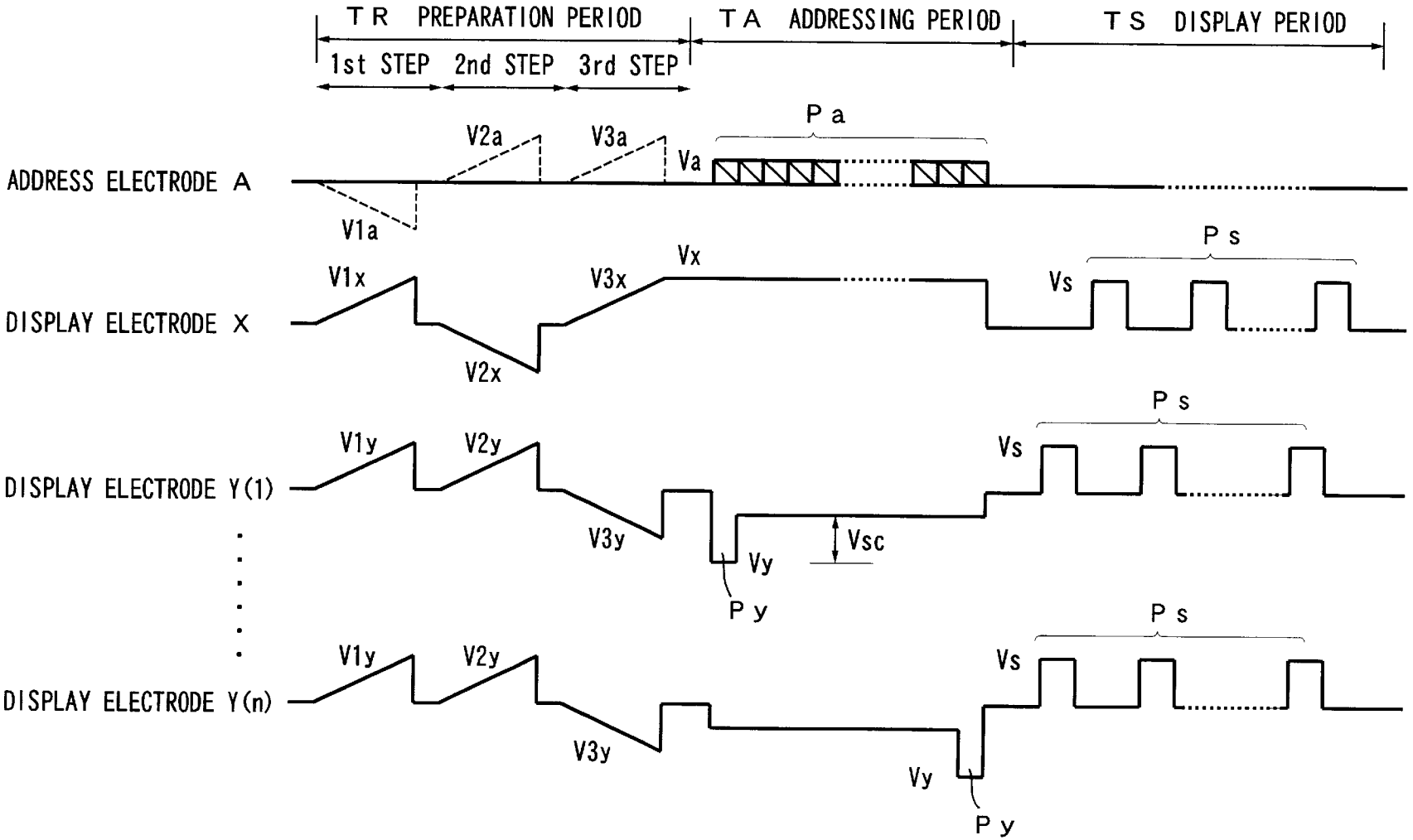
FIG. 7 shows voltage waveforms of a second example of the drive sequence.
Figure 22:
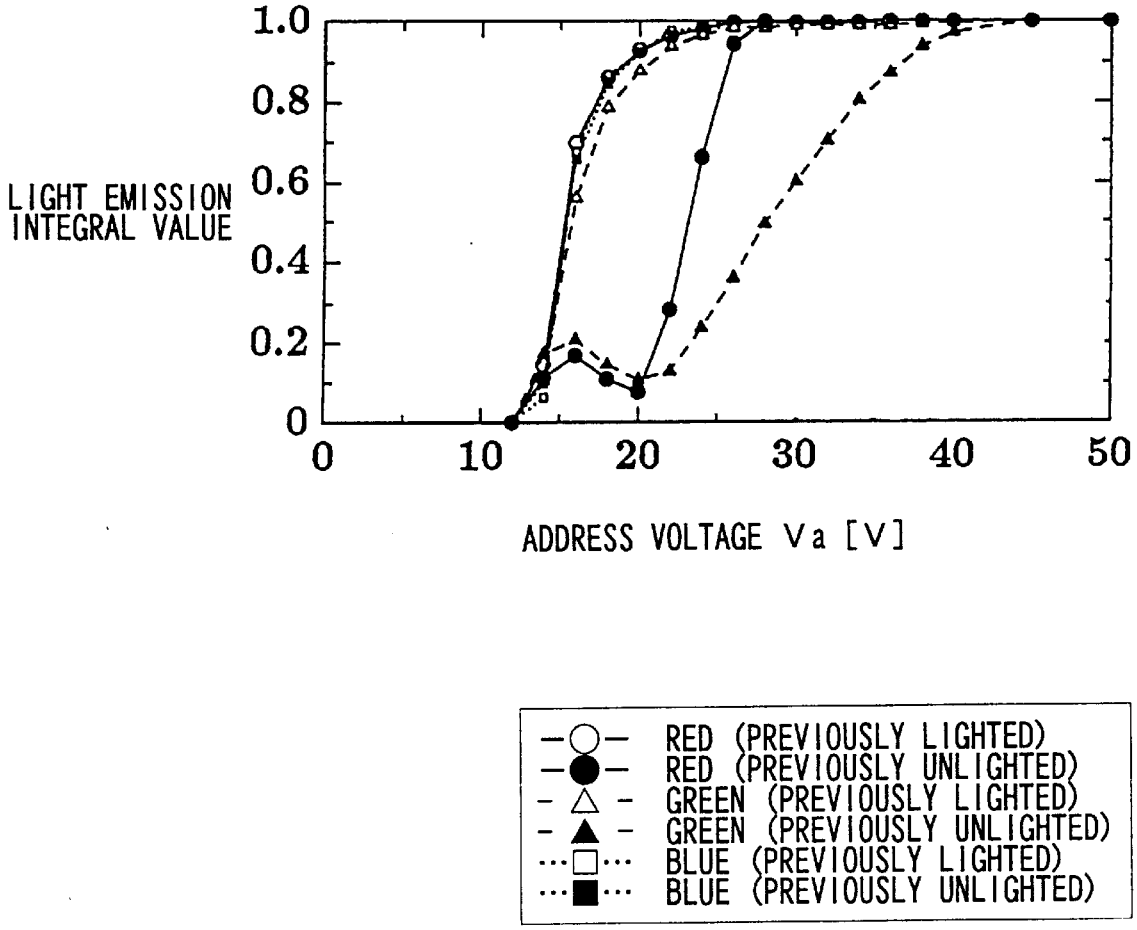
FIG. 22 is a graph showing the dependence of the address discharge on the voltage in the driving method of performing the two-step preparation process.
Figure 23A:
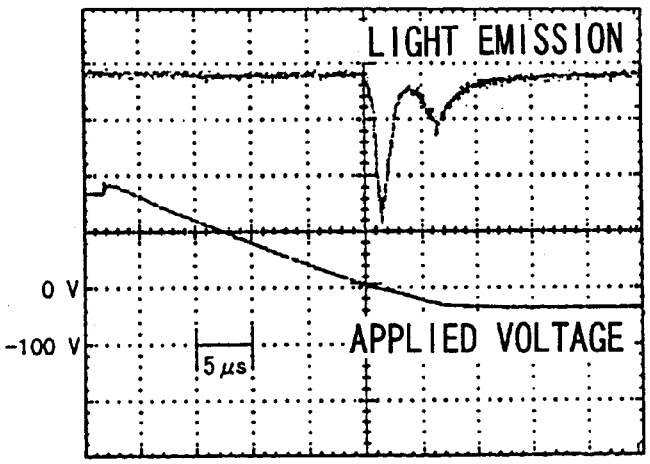
FIGS. 23A and 23B show wall voltage at the interelectrode XA in the driving method of performing the two-step preparation process.
Figure 23B:
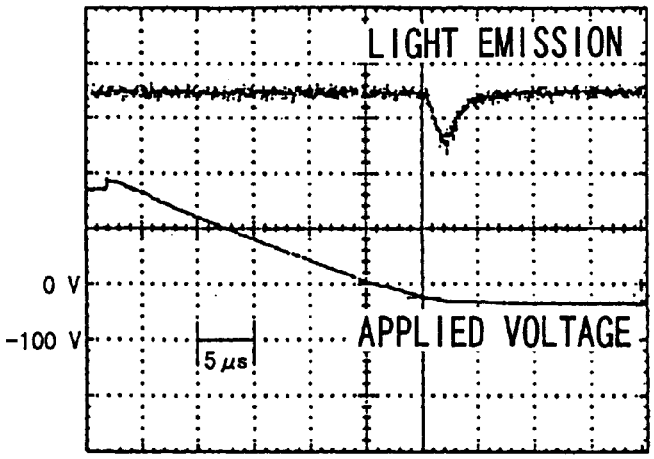

It is obvious from the comparison of FIG. 5 with FIG. 22 that according to the present invention the minimum value of the address voltage Va that can perform the correct addressing so that the light emission integral value becomes one is lower than in the two-step preparation process, and the voltage margin of addressing is enlarged. As shown in FIG. 6A, in the previously unlighted cell, the discharge occurs when the applied voltage is −16 volts. As shown in FIG. 6B, in the previously lighted cell, the discharge occurs when the applied voltage is −15 volts. The difference between the wall voltages of the interelectrode XA due to the display pattern was reduced to one volt. FIG. 7 shows voltage waveforms of a second example of the drive sequence. In this example, the order of the charge forming and the charge adjusting for three kinds of interelectrodes is different from the example of FIG. 4.

First, charge forming discharge is generated at the interelectrode XA and the interelectrode YA so as to generate a proper wall voltage at these interelectrodes XA and YA (a first step). Next, a ramp voltage having an opposite polarity from the first step is applied to the interelectrode XA, and a ramp voltage is applied to the interelectrode XY so as to generate the charge forming discharge. Thus, the wall voltage of the interelectrode XA is reduced (charge adjusting) and the charge forming at the interelectrode XY is performed (a second step). Then, a ramp voltage having a polarity opposite from the first step is applied to the interelectrode YA, and a ramp having a polarity opposite from the second step is applied to the interelectrode XY. Thus, the charge adjusting at the interelectrode YA and the interelectrode XY is performed (a third step).

Figure 8:
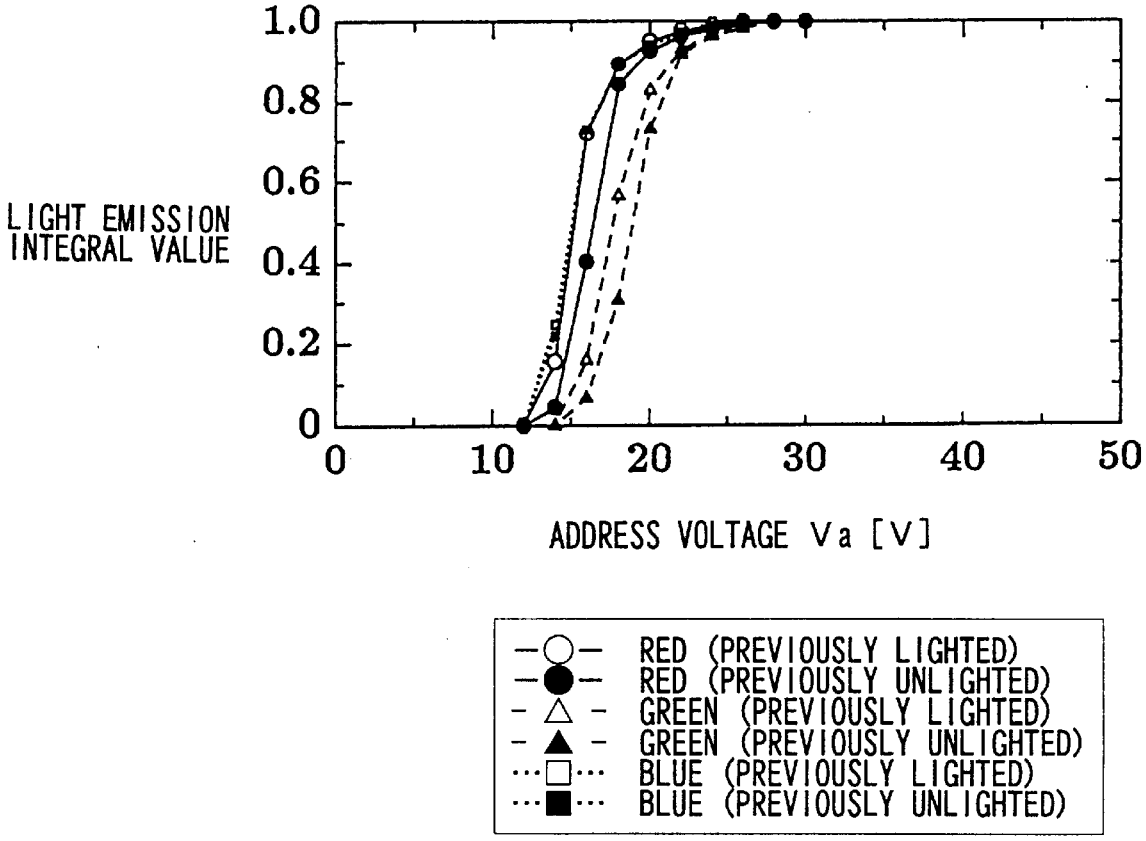
FIG. 8 is a graph showing a dependence of the address discharge on the voltage in the driving method shown in FIG. 7.

FIG. 8 is a graph showing a dependence of the address discharge on the voltage in the driving method shown in FIG. 7. The measurement method is similar to the evaluation of the conventional method. The voltage condition in FIG. 8 is shown in Tables 7 and 8.

TABLE 7

| V1a | V1x | V1y | V2a | V2x | V2y | V3a | V3x | V3y |
|---|---|---|---|---|---|---|---|---|
| 0 | 300 | 340 | 0 | −110 | 240 | 0 | 110 | −90 |

(The unit is volts)

TABLE 8

| Vx | Vy | Vsc | Va | Vs |
|---|---|---|---|---|
| 0 | −110 | 60 | 70 | 170 |

(The unit is volts)

In FIG. 8, the variation of the address voltage due to the display pattern is less than in FIG. 5. The address voltage that enables the correct addressing despite of the display pattern is low, and the voltage margin is large.

Next, the condition of the ramp voltage will be explained. Here, the electrodes I, J are assumed, and the voltage of the interelectrode IJ is indicated by the following symbols.

The amplitude of the ramp voltage applied for charge forming: ${}^{(IJ)}\mathrm{Vm}$, ${}^{(JI)}\mathrm{Vm}$ The amplitude of the ramp voltage applied for charge adjusting: ${}^{(IJ)}\mathrm{Vn}$, ${}^{(JI)}\mathrm{Vn}$ The discharge starting voltage (in the case electrode J is a cathode): ${}^{(IJ)}\mathrm{Vf}_t$ (>0)

The discharge starting voltage (in the case electrode I is a cathode): ${}^{(JI)}\mathrm{Vf}_t$ (>0)

The wall voltage before charge forming: ${}^{(IJ)}\mathrm{Vw}_o$, ${}^{(JI)}\mathrm{Vw}_o$ The wall voltage after charge forming and before charge adjusting: ${}^{(IJ)}\mathrm{Vw}_m$, ${}^{(JI)}\mathrm{Vw}_m$ The wall voltage after charge adjusting: ${}^{(IJ)}\mathrm{Vw}_n$, ${}^{(JI)}\mathrm{Vw}_n$, The superscript prefix (IJ) means a voltage based on the potential of the electrode J, and the superscript prefix (JI) means a voltage based on the potential of the electrode I. The interelectrode IJ corresponds to any one of the interelectrodes XY, XA and YA.

Figure 9:
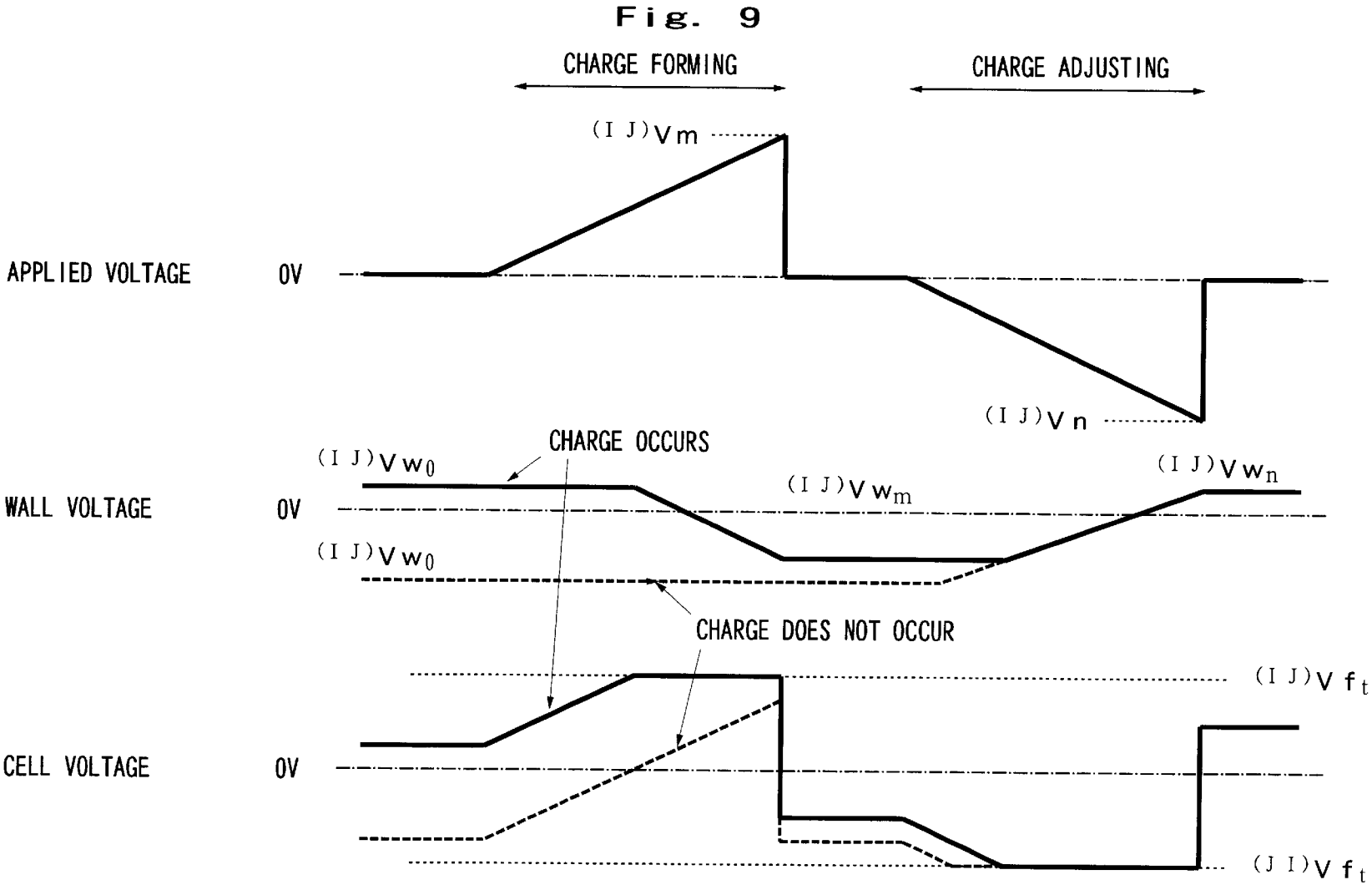
FIG. 9 is a schematic diagram of the voltage change at the interelectrode IJ.

FIG. 9 is a schematic diagram of the voltage change at the interelectrode IJ.

In order to perform the charge adjusting, minute discharge (charge adjusting discharge) should be occur when the second ramp voltage is applied. If the discharge occurs, the wall voltage is adjusted to a constant value depending on ${}^{(JI)}\mathrm{V}_n$ in accordance with the following equation.

$$ {}^{(JI)}Vw_n = {}^{(JI)}Vf_t - {}^{(JI)}Vn \quad (2\text{-}1) $$

The condition is derived from the following inequality.

$$^{(IJ)}Vn+^{(IJ)}Vw_m>^{(IJ)}Vf_t \quad (2\text{-}2)$$

At the stage of charge forming, the discharge can occur or cannot occur. If the discharge does not occur, $^{(IJ)}Vw_m=^{(IJ)}Vw_o$. If the discharge occurs, $^{(IJ)}Vw_m=^{(IJ)}Vf_t-^{(IJ)}Vm$.

The condition of generating the discharge at the charge forming stage is expressed as follows.

$$^{(IJ)}Vm+^{(IJ)}Vw_o>^{(IJ)}Vf_t \quad (2\text{-}3)$$

Therefore, the following equation is derived.

$$^{(IJ)}Vw_m=\min(^{(IJ)}Vf_t-^{(IJ)}Vm,\ ^{(IJ)}Vw_o)=-^{(IJ)}Vw_m \quad (2\text{-}4)$$

As a result, the following inequality is derived.

$$^{(IJ)}Vw_m>-(^{(IJ)}Vf_t-^{(IJ)}Vm) \quad (2\text{-}5)$$

With reference to the inequality (2-2), if the following expression is satisfied, the discharge will occur at the charge forming stage.

$$^{(IJ)}Vm-^{(IJ)}Vn>^{(IJ)}Vf_t+^{(IJ)}Vf_t \quad (2\text{-}6)$$

Thus, the wall voltage of the interelectrode IJ can be adjusted by applying ramp voltages having different polarities.

Accordingly, the voltage is set so as to satisfy the condition defined by the inequality (2-6) using three kinds of interelectrodes XY, XA and YA. If the discharge occurs at the interelectrodes XA and YA between the charge forming and the charge adjusting as the interelectrode XY in the sequence shown in FIG. 4 for example, the charged state after the charge forming can be disturbed and the inequality (2-6) may not be satisfied. In this case too, the inequality (2-6) can be a guideline for setting though some adjustment of setting is required. Even if the inequality (2-6) is not satisfied at all interelectrodes, the range of the wall voltage is limited by applying the voltage to two kinds of interelectrodes simultaneously so that the effect of initialization can be expected partially. Since it is necessary for addressing preparation that the discharge occurs when the last ramp voltage is applied to each interelectrode, it is possible to apply a rectangular pulse voltage instead of the ramp voltage first and to adjust the wall voltage just before the last application so that the discharge occurs by the last ramp voltage. It is also possible to perform the preparation process only by one polarity of ramp voltage if the driving waveform is made so as to restrict the value of the wall voltage before the preparation process.

Figure 10:
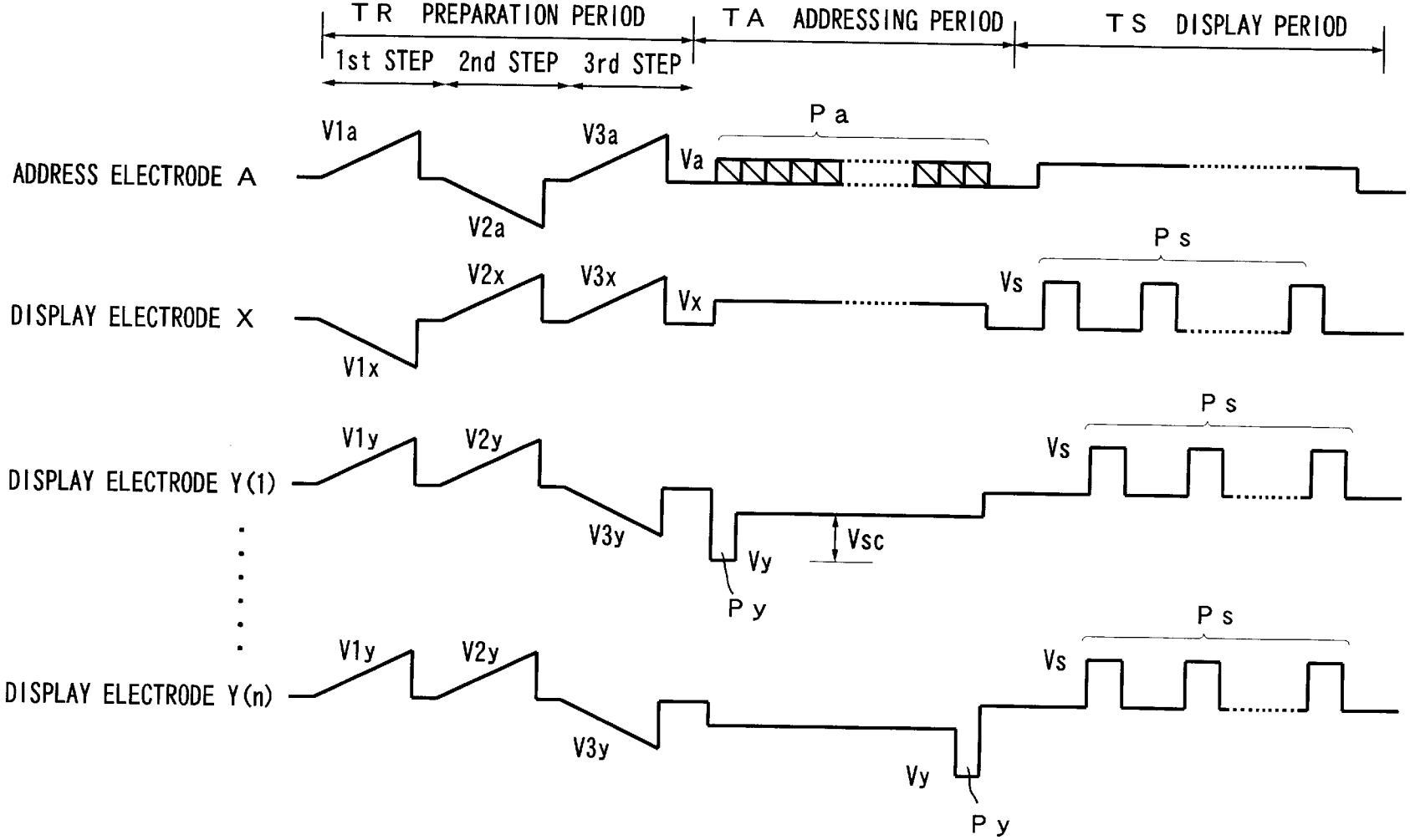
FIG. 10 shows voltage waveforms of a third example of the drive sequence.

FIG. 10 shows voltage waveforms of a third example of the drive sequence.

In the preparation period TR, the charge forming and the charge adjusting are performed for three kinds of interelectrodes in the same order as in FIG. 4. In the addressing period TA, the erasing format addressing is performed. In the display period TS, the address electrode A is biased so as to prevent undesirable discharge, and the sustaining pulse Ps is applied to the display electrodes X, Y alternately with regarding the display electrode X as a first application target.

Figure 11:
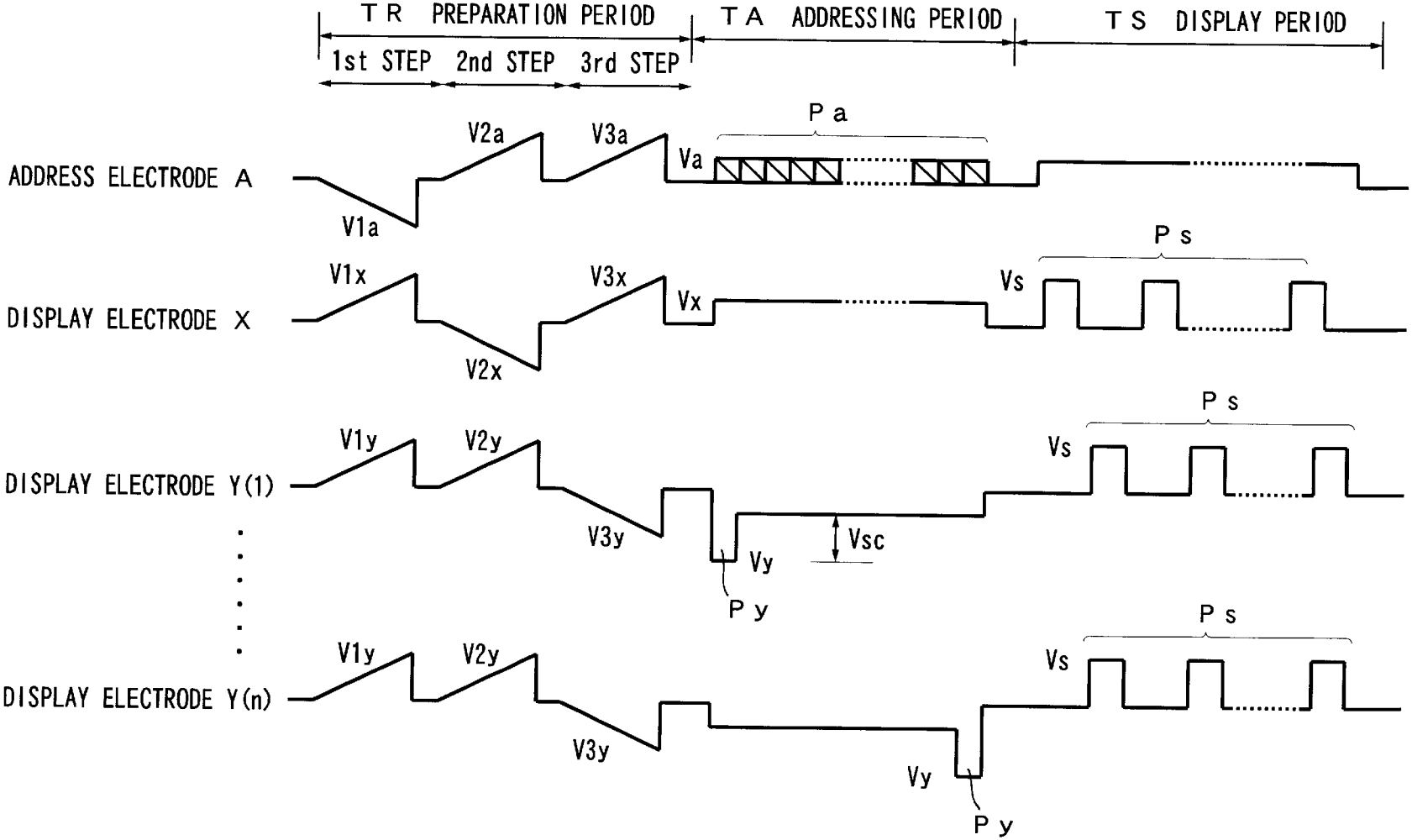
FIG. 11 shows voltage waveforms of a fourth example of the drive sequence.

FIG. 11 shows voltage waveforms of a fourth example of the drive sequence.

In the preparation period TR, the charge forming and the charge adjusting are performed for three kinds of interelectrodes in the same order as in FIG. 7. The operation after that is the same as in FIG. 10.

In the addressing, a priming address method can be used in which address discharge having different intensity corresponding to display data not limited to setting of on and off in accordance with on and off of the address discharge.

Figure 12:
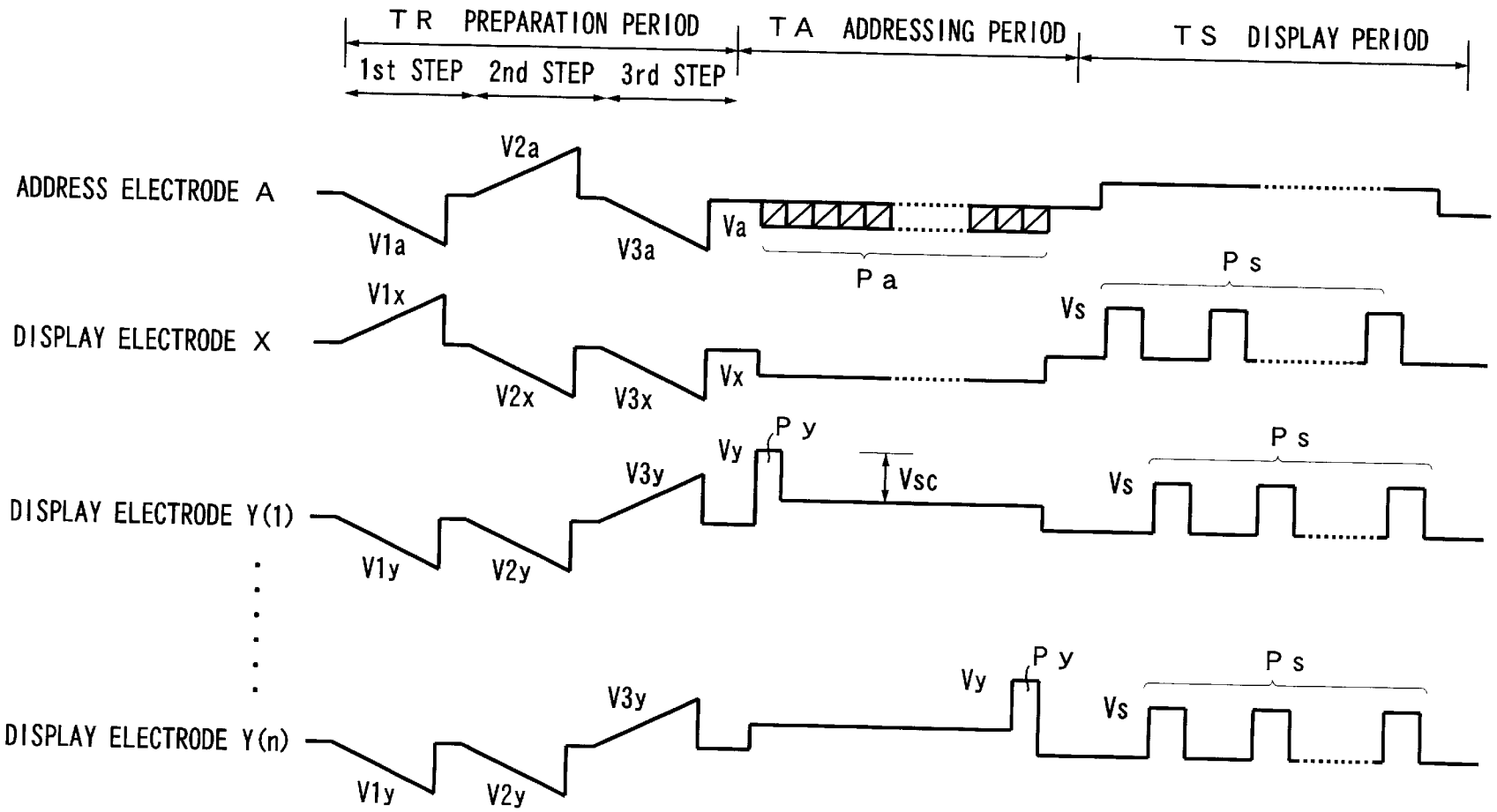
FIG. 12 shows voltage waveforms of a fifth example of the drive sequence.
Figure 13:
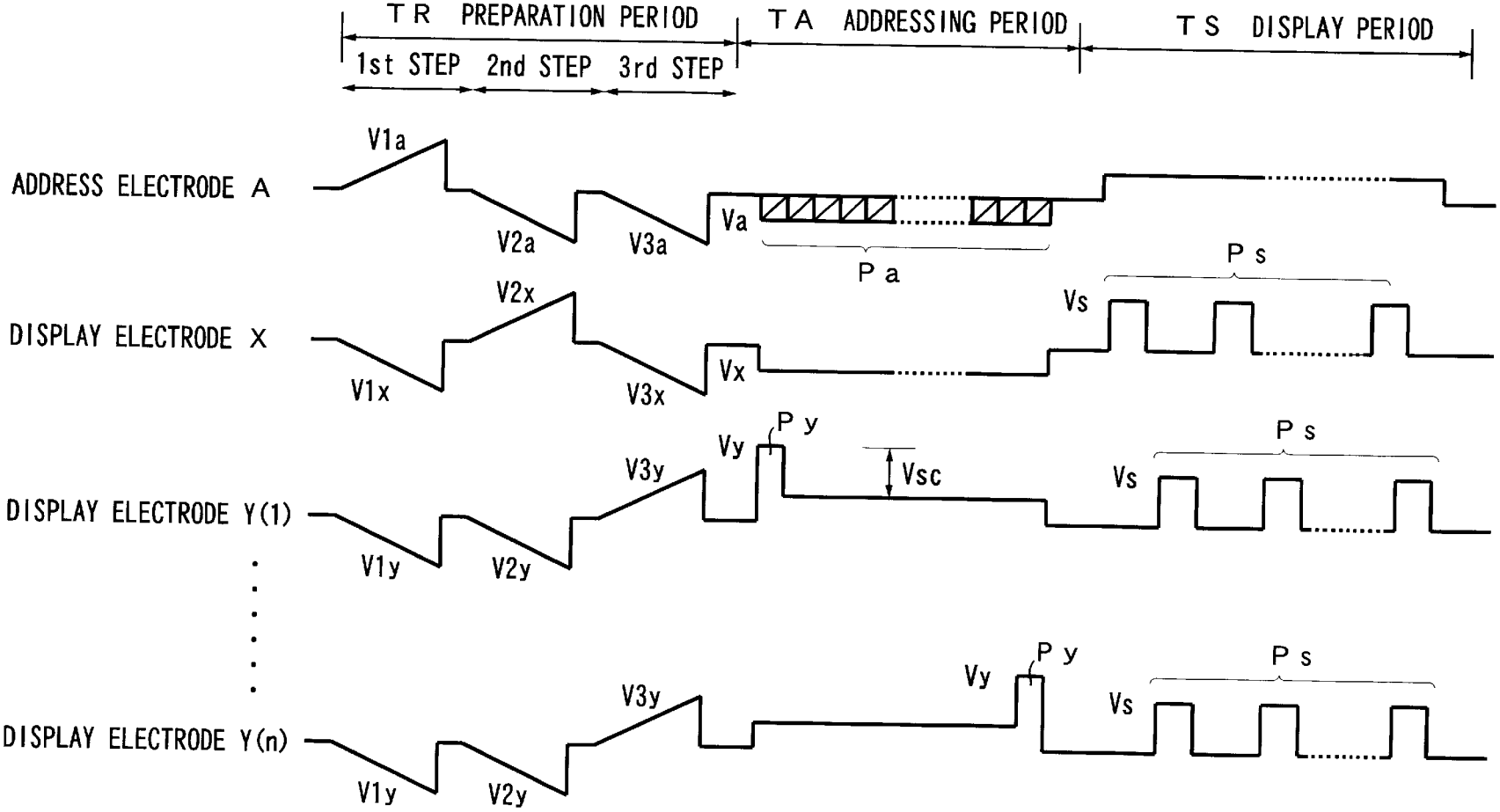
FIG. 13 shows voltage waveforms of a sixth example of the drive sequence.

FIG. 12 shows voltage waveforms of a fifth example of the drive sequence. FIG. 13 shows voltage waveforms of a sixth example of the drive sequence.

In the addressing, the address discharge is generated by the address electrode A as a cathode. In the same time, the polarity of the applied voltage in the preparation period TR is selected. The order of the charge forming and the charge adjusting for three kinds of interelectrodes in FIG. 12 is the same as that in FIG. 4. The order of the charge forming and the charge adjusting for three kinds of interelectrodes in FIG. 13 is the same as that in FIG. 7.

Figure 14:
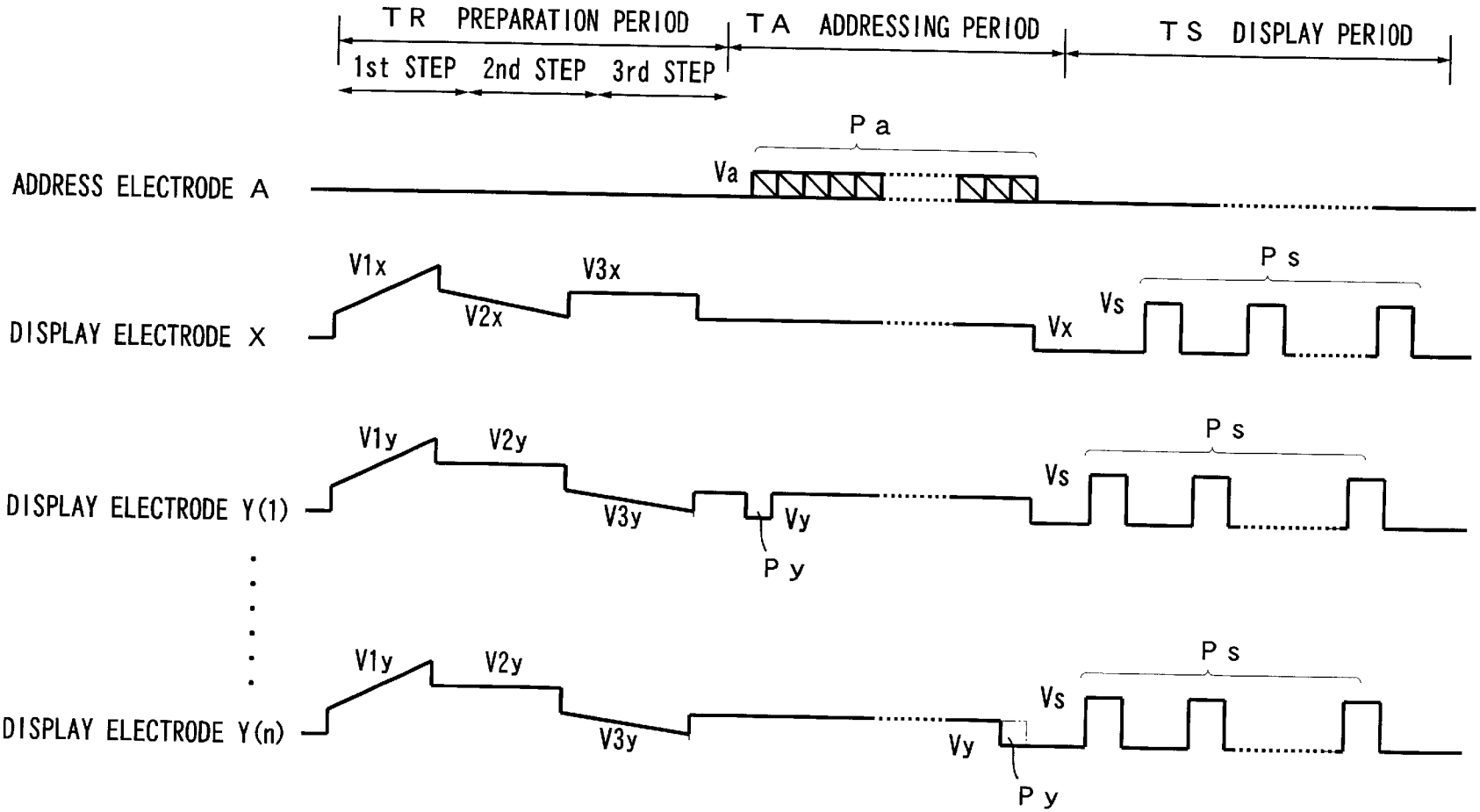
FIG. 14 shows voltage waveforms of a seventh example of the drive sequence.

FIG. 14 shows voltage waveforms of a seventh example of the drive sequence.

In order to simplify the power source circuit, only a power supply is used that biases the electrodes X, Y and A to a positive potential with respect to the GND. A trapezoidal voltage generated by adding an offset to the increase starting voltage of the ramp voltage is applied so as to shorten the time period necessary for the preparation process.

Figure 15:
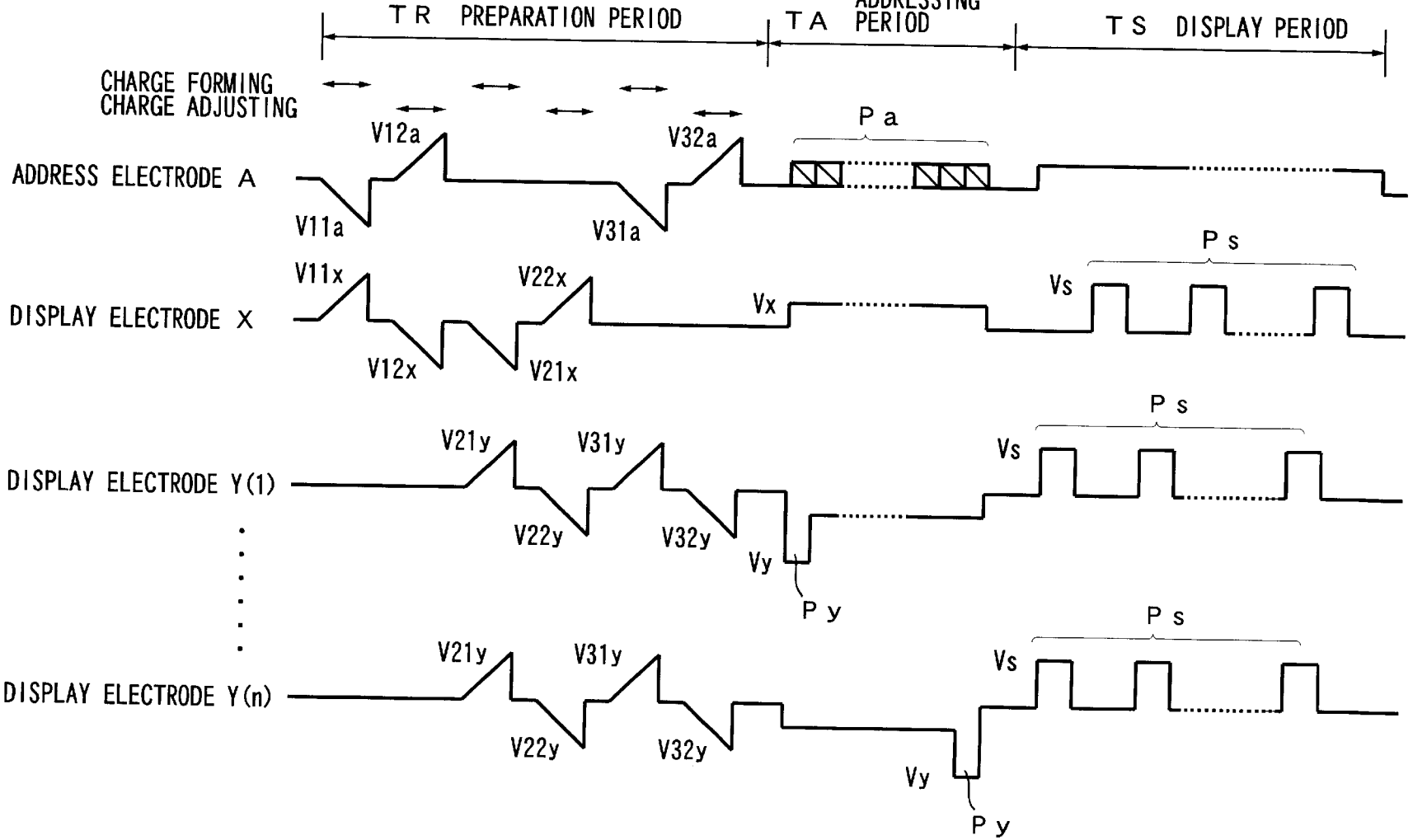
FIG. 15 shows voltage waveforms of an eighth example of the drive sequence.

FIG. 15 shows voltage waveforms of an eighth example of the drive sequence.

The charge adjusting is performed for three kinds of interelectrodes XY, XA and YA one by one. The ramp waveform pulse is applied to each electrode four times. Namely, the increasing voltage is applied to each interelectrode two times. In the illustrated example, the charge forming and the charge adjusting are performed for the interelectrode XA, the interelectrode XY and the interelectrode YA in this order. The disturbance of the charge is less than the case where the voltage is applied to two kinds of interelectrode simultaneously, and the voltage setting is easier. However, there is a disadvantage in that the preparation period TR increases. This example is suitable for the case in which the preparation process is performed only for a part of the plural subfields constituting a high definition field.

As explained above, the charge control by the increasing voltage has an advantage in that the minute discharge with a little light emission quantity can uniform the charge distribution that is advantageous for a contrast, adding to the compensation of the variation of the discharge characteristics. However, if a certain subfield is lighted by the entire surface, the contrast does not decrease even if a strange discharge occurs in the preparation period of the subfield following the above-mentioned subfield. In this case, the above-mentioned condition of the inequality (2-6) is relieved, so that the application time can be shortened by increasing the gradient of the ramp waveform.

It is also possible that only when a certain subfield is in the lighted state, the erasing discharge is generated at the final stage of the display period so as to drop the wall voltage to a value close to the unlighted state, and a strong discharge does not occur in the preparation period. This structure will be explained below.

The value of the wall voltage $^{(IJ)}Vw_o$ is different in accordance with that the previous subfield is lighted or unlighted. If the previous subfield is unlighted, the value of the wall voltage $^{(IJ)}Vw_o$ can be regarded as zero. If the previous subfield is lighted, the wall voltage of the interelectrode XY changes its polarity in every discharge. For example, in the sequence of FIG. 7, a negative wall charge remains in the display electrode X, and a positive wall charge remains in the display electrode Y at the end of the display period TS. There is little wall charge in the vicinity of the address electrode A. In the relationship with the sustaining voltage Vs, the $^{(YA)}Vw_o$ is approximately Vs/2, and the $^{(XA)}Vw_o$ is approximately −Vs/2. The $^{(YA)}Vw_o$ has the same polarity as the $^{(YA)}$V1, and the $^{(XA)}Vw_o$ has the opposite polarity from the $^{(XA)}$V1.

Figure 16:
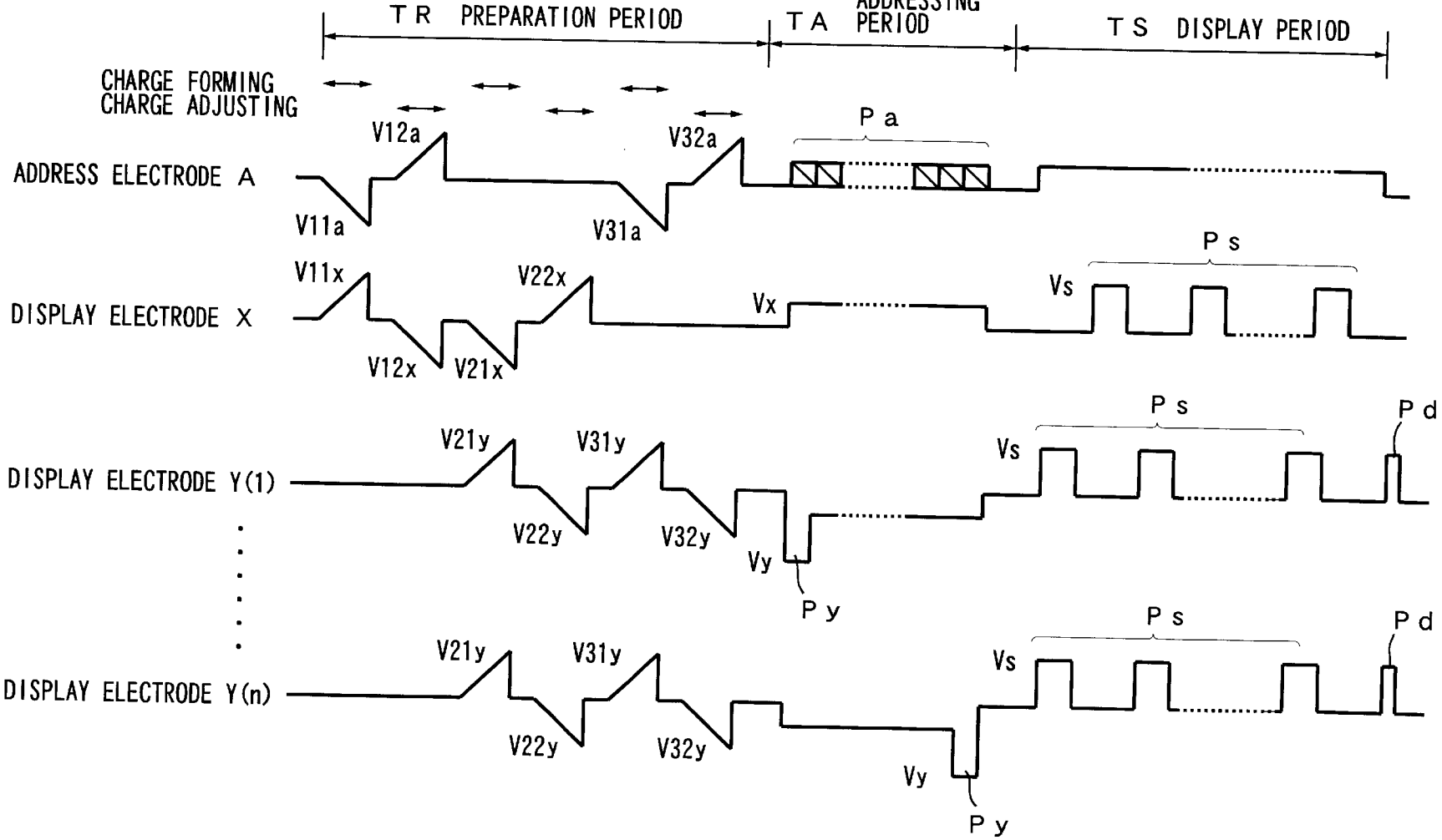
FIG. 16 shows voltage waveforms of a ninth example of the drive sequence.
Figure 17:
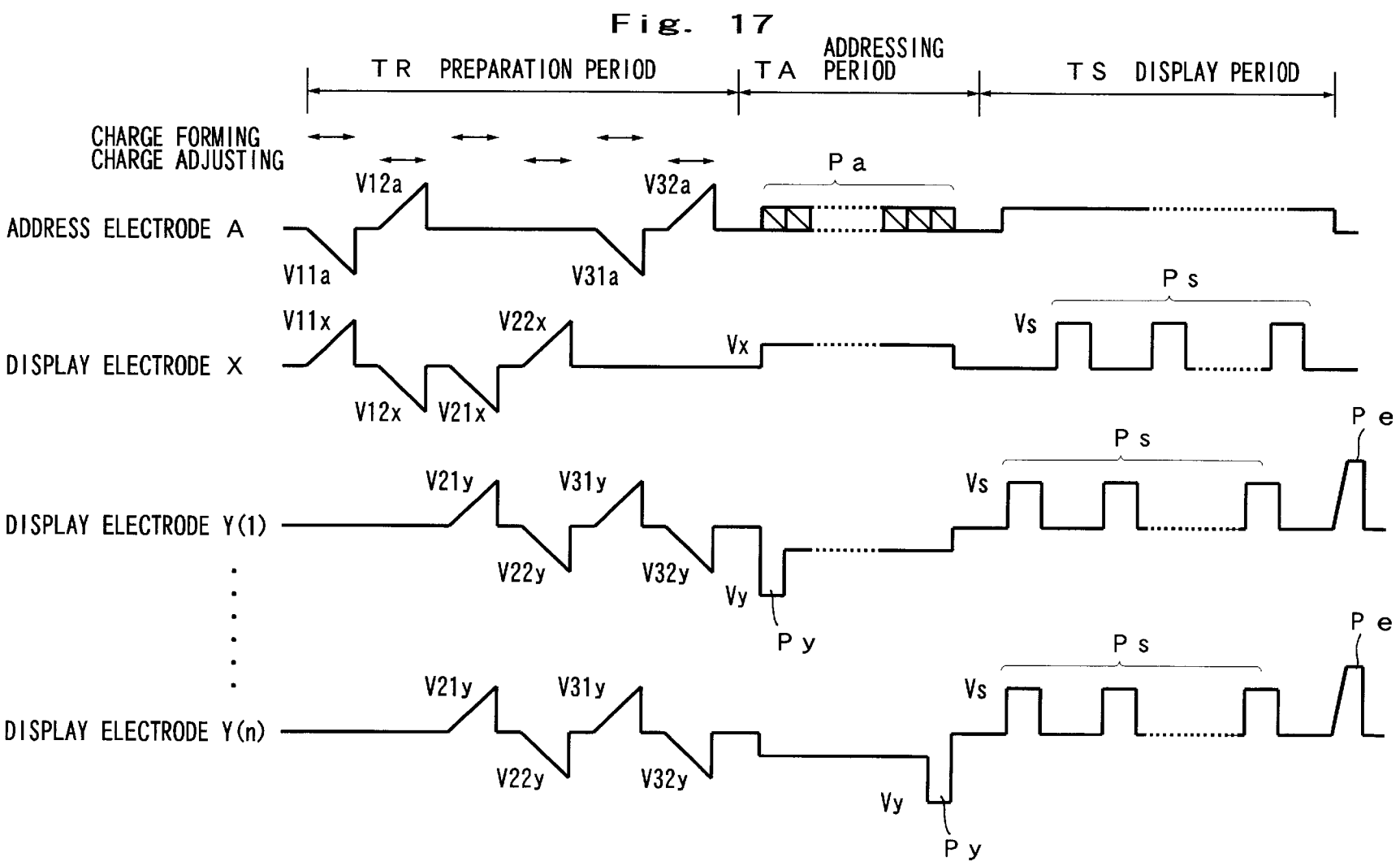
FIG. 17 shows voltage waveforms of a tenth example of the drive sequence.

As shown in a ninth example of FIG. 16 or in a tenth example of FIG. 17, a pulse Pd having a small width of approximately 500 ns or a ramp waveform pulse Pe having a steep gradient is applied at the final stage of the display period so as to generate the erasing discharge. Thus, the same state as in the unlighted case can be obtained. Despite of the display pattern of the previous subfield, the $^{(YA)}Vw_o$ and $^{(XA)}Vw_o$ can be substantially zero, so that the time period for generating the minute discharge can be shortened. Here, the steep gradient of the ramp waveform means a gradient that can generate an impulsive strong discharge, and it can be a slow waveform.

The drive sequence can be variously arranged and can be a combination of the above-mentioned examples. The voltage applied for generating the minute discharge is not limited to the ramp voltage and is not required to increase at a constant rate from zero. Since the discharge does not occur before the applied voltage reaches the discharge starting voltage Vf, it is possible to apply such a voltage that the cell voltage rapidly reaches a predetermined value below the discharge starting voltage and then mildly increases to a predetermined voltage Vr considering the wall voltage.

Figure 18:
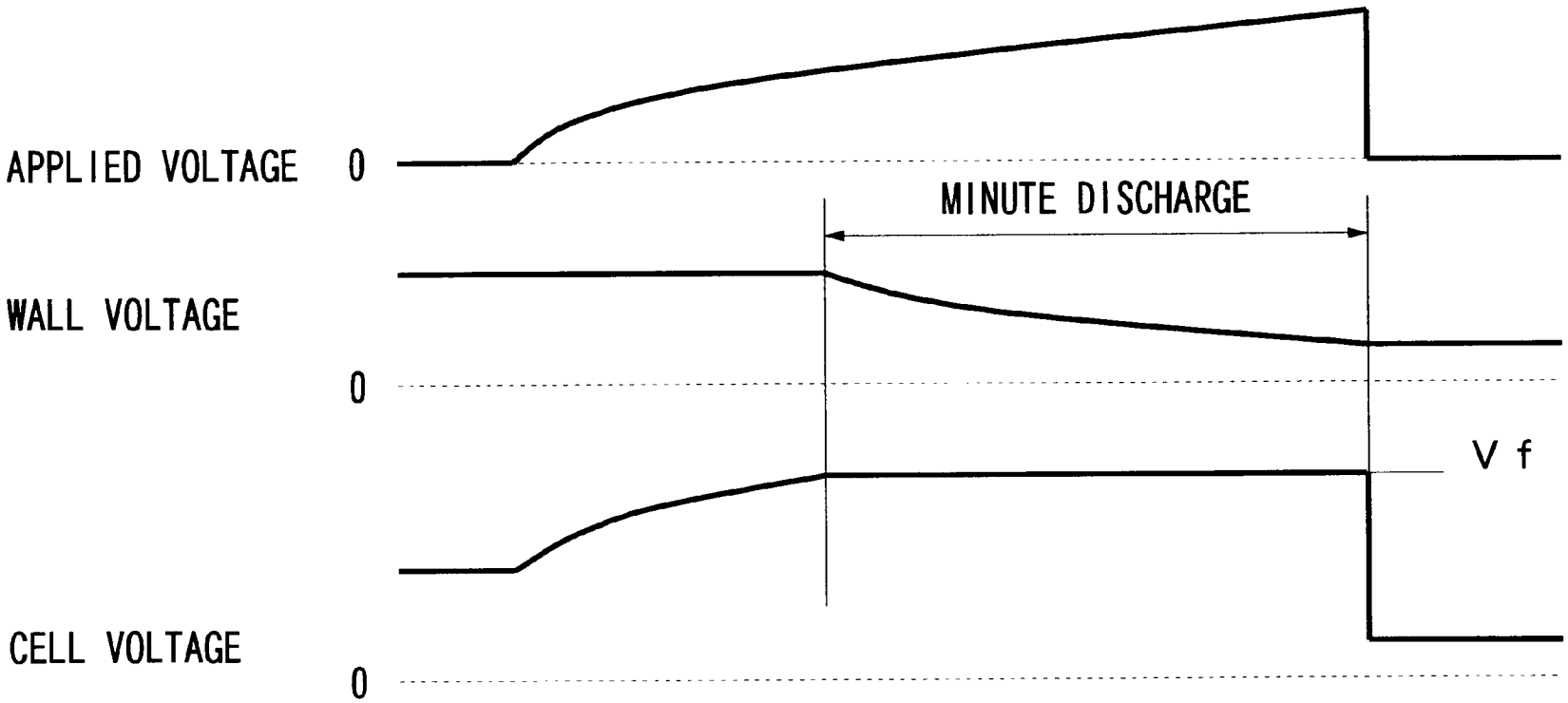
FIG. 18 shows a first variation of the drive waveform.
Figure 19:
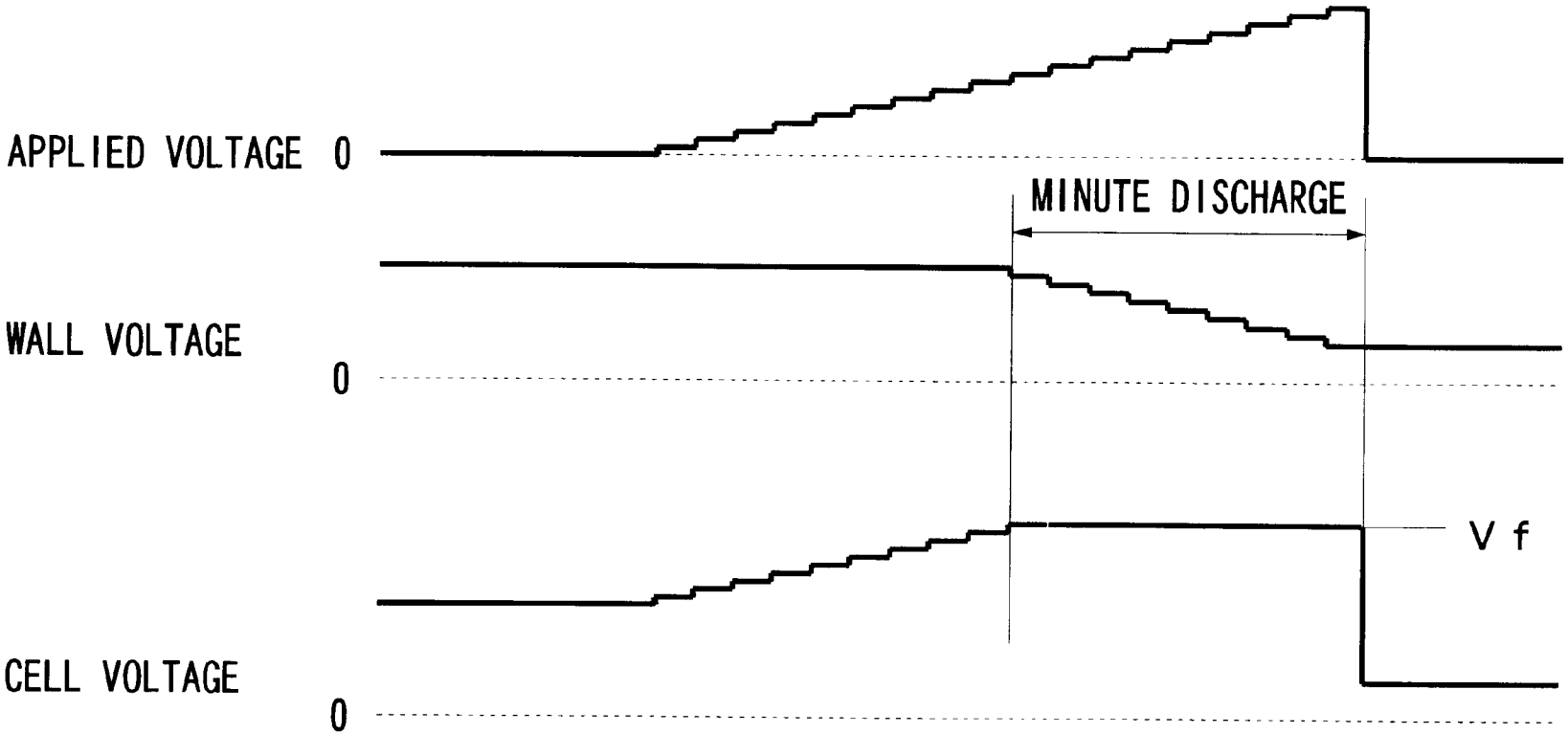
FIG. 19 shows a second variation of the drive waveform.

FIG. 18 shows a first variation of the drive waveform. FIG. 19 shows a second variation of the drive waveform.

Instead of the ramp voltage a slow waveform voltage can be applied for generating the minute discharge. However, the cell voltage should not reach the discharge starting voltage before the increase of the voltage becomes slow. A step waveform voltage having a minute step can be applied for generating the minute discharge. By setting the step the amplitude of the minute discharge can e controlled. In the real driving, the voltage can drop temporarily at the discharge due to an impedance of the power source. The increasing voltage in this specification includes a voltage whose waveform increases with microscopic waving due to the temporary drop at each discharge.

Figure 20:
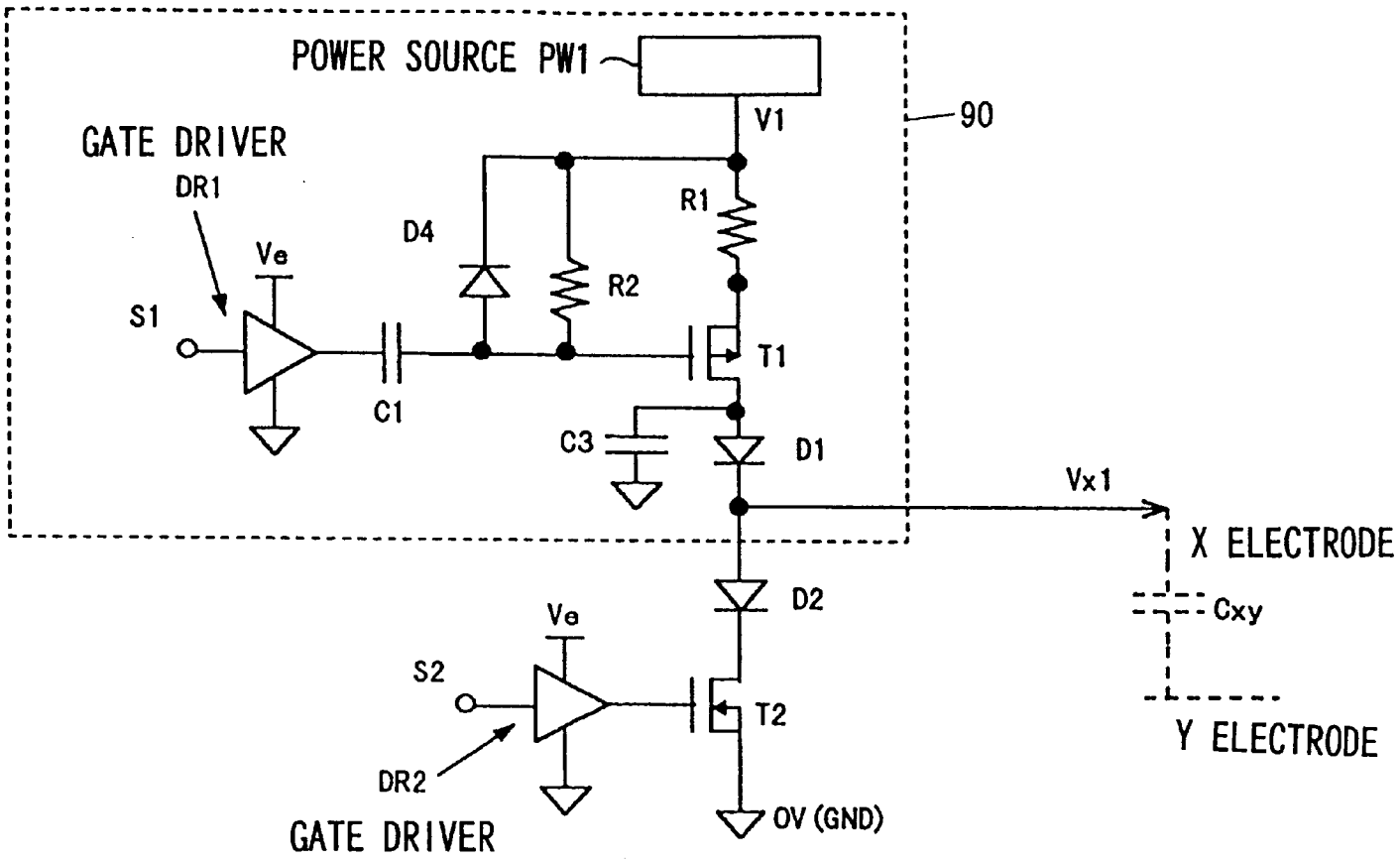
FIG. 20 is a structural diagram of a ramp waveform generating circuit.
Figure 21:
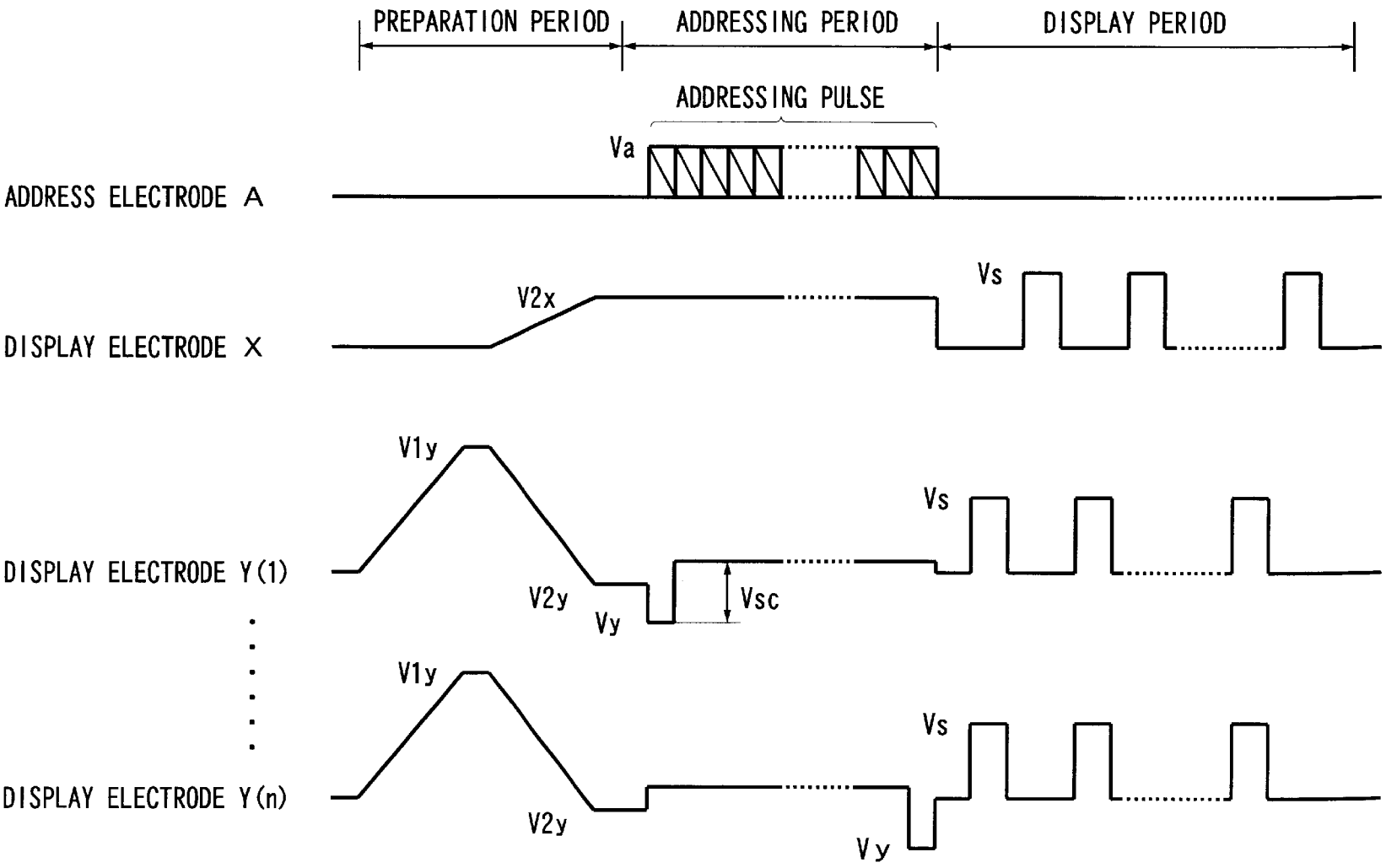
FIG. 21 shows voltage waveforms of the driving method of performing the two-step preparation process.

FIG. 20 is a structural diagram of a ramp waveform generating circuit.

The ramp waveform generating circuit 90 includes a power source PW1 that generates the voltage V1, a switching transistor T1 and a gate driver DR1 for driving the gate electrode of the transistor T1. A resistor R1 is inserted between the power source PW1 and the source electrode of the transistor T1, and the output of the gate driver DR1 is given to the gate electrode of the transistor T1 via an AC coupling of the capacitance C1. The gate driver DR1 shapes the timing signal S1 and outputs a pulse having an amplitude Ve. The gate electrode of the transistor T1 is supplied with a control pulse having an amplitude Ve with respect to the power source voltage V1, and the potential thereof becomes Ve−V1. The gate-source threshold level Vth is set so that the inequality Ve>Vth is satisfied. If the transistor T1 is turned on and current flows from the power source PW1 to a capacitive load Cxy at the interelectrode XY, for example, the resistor RI generates a voltage drop, and the source electrode potential of the transistor T1 is maintained at V1−Ve+Vth. At this time, the transistor T1 is maintained in the ON state, and the current flowing through the transistor T1 becomes a constant value (Ve−Vth)/R1 so that the potential of the capacitive load Cxy rises at a constant gradient. This gradient can be controlled by the resistor R1 or the voltage Ve as shown in accordance with the equation dV/dt=((Ve−Vth)/R1)/Cxy. When the transistor T1 is turned off and the transistor T2 is turned on, the charge of the capacitive load Cxy is discharged to the ground line through the diode D2 and the transistor T2 so that the waveform becomes back to zero volt (the GND potential). In order to apply ramp voltages having different amplitudes in the preparation period TR as explained above, a necessary number of circuits having the same configuration as in FIG. 20 is provided.

If the addressing preparation process is performed in accordance with the present invention, the cell voltage of each cell is the discharge starting voltage of each cell when applying the reach voltage of the ramp voltage just before the addressing. Therefore, the intensity of the address discharge depends on the difference voltage $^{(IJ)}$V30=$^{(IJ)}$V20−$^{(IJ)}$V10 between the voltage $^{(IJ)}$V20 applied to the interelectrode that generates the address discharge at the address discharge and the reach voltage $^{(IJ)}$V10 of the ramp waveform that was applied to the interelectrode last. A power source (power sources V10 and V30) is used that directly sets the difference voltage $^{(IJ)}$V30, so that the drive circuit becomes more endurable for a variation of the power source voltage than the independent power source configuration (power sources V10 and V20).

As explained above, the present invention can enlarge the voltage margin of the addressing and can realize a stable display.

What is claimed is:

1. A method for driving a plasma display panel including first and second display electrodes making electrode pairs for generating surface discharge for each row of a screen, a dielectric layer for insulating the electrode pairs from the discharge space and address electrodes crossing the first and second display electrodes via the dielectric layer, the method comprising a charge forming step and a charge adjusting step as a preparation process of addressing for forming charge distribution corresponding to display contents, wherein the charge forming step generates wall voltage having the same polarity at the same kind of interelectrode of all cells constituting the screen, for three kinds of interelectrodes, an interelectrode XY between the display electrodes, an interelectrode XA between the first display electrode and the address electrode, and an interelectrode YA between the second display electrode and the address electrode, and the charge adjusting step decreases the wall voltage by applying an increasing voltage that increases continuously or step by step.

2. The method according to claim 1, wherein the charge forming step is performed by applying an increasing voltage that increases monotonously and continuously or step by step.

3. The method according to claim 1, wherein the increasing voltage applied to at least one kind of interelectrode is a ramp voltage.

4. The method according to claim 1, wherein the increasing voltage applied to at least one kind of interelectrode is a slow waveform voltage.

5. The method according to claim 1, wherein the increasing voltage applied to at least one kind of interelectrode is a step waveform voltage.

6. The method according to claim 1, wherein a bias voltage for shortening the application period is added to the increasing voltage applied to at least one kind of interelectrode.

7. The method according to claim 1, wherein the charge forming step and the charge adjusting step are performed for each of the three kinds of interelectrode sequentially.

8. The method according to claim 1, wherein the application of the increasing voltage is performed for two of the three kinds of interelectrode simultaneously.

9. The method according to claim 8, wherein the addressing is performed by generating the address discharge in both the interelectrode YA and the interelectrode XY using the second display electrode as a cathode, and the preparation process includes a first step for applying a voltage for generating charge forming discharge at the interelectrode XA and the interelectrode YA using the address electrode as a cathode, a second step for applying the increasing voltage to the interelectrode XA after the first step, the increasing voltage having a polarity that makes the first display electrode a cathode, and for applying a voltage for generating charge forming discharge at the interelectrode XY using the first display electrode as a cathode, and a third step for applying the increasing voltage to the interelectrode XY and the interelectrode YA after the second step, the increasing voltage having a polarity that makes the second display electrode a cathode.

10. The method according to claim 8, wherein the addressing is performed by generating the address discharge in both the interelectrode YA and the interelectrode XY using the second display electrode as a cathode, and the preparation process includes a first step for applying a voltage for generating charge forming discharge at the interelectrode XY and the interelectrode XA using the first display electrode as a cathode, a second step for applying the increasing voltage to the interelectrode XA after the first step, the increasing voltage having a polarity that makes the address electrode a cathode, and for applying a voltage for generating charge forming discharge at the interelectrode YA using the address electrode as a cathode, and a third step for applying the increasing voltage to the interelectrode XY and the interelectrode YA after the second step, the increasing voltage having a polarity that makes the second display electrode a cathode.

11. The method according to claim 8, wherein the addressing is performed by generating the address discharge in both the interelectrode YA and the interelectrode XY using the second display electrode as an anode, and the preparation process includes a first step for applying a voltage for generating charge forming discharge at the interelectrode XA and the interelectrode YA using the address electrode as an anode, a second step for applying the increasing voltage to the interelectrode XA after the first step, the increasing voltage having a polarity that makes the first display electrode an anode, and for applying a voltage for generating charge forming discharge at the interelectrode XY using the first display electrode as an anode, and a third step for applying the increasing voltage to the interelectrode XY and the interelectrode YA after the second step, the increasing voltage having a polarity that makes the second display electrode an anode.

12. The method according to claim 8, wherein the addressing is performed by generating the address discharge in both the interelectrode YA and the interelectrode XY using the second display electrode as an anode, and the preparation process includes a first step for applying a voltage for generating charge forming discharge at the interelectrode XY and the interelectrode XA using the first display electrode as an anode, a second step for applying the increasing voltage to the interelectrode XA after the first step, the increasing voltage having a polarity that makes the address electrode an anode, and for applying a voltage for generating charge forming discharge at the interelectrode YA using the address electrode as an anode, and a third step for applying the increasing voltage to the interelectrode XY and the interelectrode YA after the second step, the increasing voltage having a polarity that makes the second display electrode an anode.

13. The method according to claim 1, wherein writing format addressing is performed in which the address discharge is generated only in the cell whose wall voltage is to increase.

14. The method according to claim 1, wherein erasing format addressing is performed in which the address discharge is generated only in the cell whose wall voltage is to decrease.

15. The method according to claim 1, wherein the addressing is performed by generating the address discharge having a first intensity or a second intensity in all cells.

16. The method according to claim 1, wherein the interelectrode XY is supplied with a voltage that decreases the wall voltage before the application of the voltage for the charge forming.

17. The method according to claim 1, wherein a power source for adding a predetermined value to the maximum value of the increasing voltage applied at the end of the interelectrode YA so as to apply a voltage for generating the address discharge to the interelectrode YA.

18. The method according to claim 1, further including the steps of constituting the field of display information of plural subfields having weights of intensity, performing the addressing and the sustaining by applying an alternating voltage to the interelectrode XY for each subfield, and performing the preparation process in the subfields except at least one of the plural subfields.

19. The method according to claim 1, further including the step of performing the preparation process in which the charge forming and the charge adjusting are performed for the three kinds of interelectrodes and the shortened preparation process in which the charge forming and the charge adjusting are performed for two kinds of interelectrodes including the interelectrode XY and the interelectrode YA, selectively in accordance with contents of display.

20. A display apparatus comprising:

a plasma display panel including first and second display electrodes constituting electrode pairs for generating surface discharge for each row of a screen, a dielectric layer for insulating the electrode pairs from the discharge space, and address electrodes crossing the first and second display electrodes via the dielectric layer; and a drive circuit for performing the method for driving the plasma display panel according to claim 1.

* * * * *